US011794091B2

(12) United States Patent
Hu

(10) Patent No.: US 11,794,091 B2
(45) Date of Patent: Oct. 24, 2023

(54) PLAYING CARD MACHINE AND DELIVERY MECHANISM THEREOF, AND PLAYING CARD SHUFFLING METHOD

(71) Applicant: ZHEJIANG XUANHE ELECTROMECHANICAL TECHNOLOGY CO., LTD., Zhejiang (CN)

(72) Inventor: Quxian Hu, Zhejiang (CN)

(73) Assignee: ZHEJIANG XUANHE ELECTROMECHANICAL TECHNOLOGY CO., LTD., Zhejiang (CN)

( * ) Notice: Subject to any disclaimer, the term of this patent is extended or adjusted under 35 U.S.C. 154(b) by 197 days.

(21) Appl. No.: 17/285,488

(22) PCT Filed: Oct. 14, 2019

(86) PCT No.: PCT/CN2019/110994
§ 371 (c)(1),
(2) Date: Apr. 15, 2021

(87) PCT Pub. No.: WO2020/078309
PCT Pub. Date: Apr. 23, 2020

(65) Prior Publication Data

US 2021/0379478 A1 Dec. 9, 2021

(30) Foreign Application Priority Data

| | | |
|---|---|---|
| Oct. 15, 2018 | (CN) | 201811198400.2 |
| Dec. 14, 2018 | (CN) | 201811533440.8 |
| Apr. 28, 2019 | (CN) | 201910347716.1 |

(51) Int. Cl.

| | |
|---|---|
| ***A63F 1/14*** | (2006.01) |
| ***A63F 1/12*** | (2006.01) |
| ***A63F 1/00*** | (2006.01) |

(52) U.S. Cl.
CPC ..... *A63F 1/14* (2013.01); *A63F 1/12* (2013.01); *A63F 2001/005* (2013.01)

(58) Field of Classification Search
CPC ..... A63F 1/14; A63F 1/12; A63F 2001/005
See application file for complete search history.

(56) References Cited

U.S. PATENT DOCUMENTS

| | | | | |
|---|---|---|---|---|
| 5,114,153 | A | 5/1992 | Rosenwinkel et al. | |
| 6,726,205 | B1 * | 4/2004 | Purton | A63F 1/14 273/148 R |

(Continued)

FOREIGN PATENT DOCUMENTS

| | | |
|---|---|---|
| CN | 201164714 | 12/2008 |
| CN | 201470051 | 5/2010 |

(Continued)

OTHER PUBLICATIONS

"International Search Report (Form PCT/ISA/210) of PCT/CN2019/110994", dated Jan. 15, 2020, with English translation thereof, pp. 1-6.

*Primary Examiner* — Michael D Dennis
(74) *Attorney, Agent, or Firm* — JCIPRNET

(57) ABSTRACT

A playing card machine and delivery mechanism thereof, and a playing card shuffling method are provided. The playing card machine includes a base and a machine core. The machine core is arranged on the base or inside the base, and the machine core includes a card receptor and a card dealer. The machine core can be driven to move up and down on the base by a machine core lifting drive mechanism. The card dealer is arranged at a center of the card receptor and is able to be driven by a rotation drive mechanism to rotate relative to the card receptor. The card dealer includes a card storage box, a card distribution mechanism, and a delivery mechanism. The card receptor is provided (Continued)

with multiple card reception positions around the card dealer.

13 Claims, 13 Drawing Sheets

(56) References Cited

U.S. PATENT DOCUMENTS

| | | | | |
|---|---|---|---|---|
| 7,500,672 | B2 | 3/2009 | Ho | |
| 9,993,719 | B2 * | 6/2018 | Krenn | A63F 1/12 |
| 2010/0283202 | A1 * | 11/2010 | Ho | A63F 1/14 273/149 R |
| 2015/0273316 | A1 * | 10/2015 | Tseng | A63F 1/14 273/149 R |
| 2015/0290528 | A1 * | 10/2015 | Sampson | A63F 1/12 273/149 R |

FOREIGN PATENT DOCUMENTS

| | | |
|---|---|---|
| CN | 102580307 | 7/2012 |
| CN | 102847311 | 1/2013 |
| CN | 103055499 | 4/2013 |
| CN | 103157272 | 6/2013 |
| CN | 203803090 | 9/2014 |
| CN | 105854274 | 8/2016 |
| CN | 108525278 | 9/2018 |
| CN | 109350955 | 2/2019 |
| CN | 110193184 | 9/2019 |
| CN | 209405638 | 9/2019 |
| CN | 209405640 | 9/2019 |
| CN | 209405641 | 9/2019 |
| CN | 209405642 | 9/2019 |
| CN | 209405643 | 9/2019 |
| CN | 209405644 | 9/2019 |
| CN | 209405645 | 9/2019 |
| CN | 209490456 | 10/2019 |

* cited by examiner

PLAYING CARD MACHINE AND DELIVERY MECHANISM THEREOF, AND PLAYING CARD SHUFFLING METHOD

CROSS-REFERENCE TO RELATED APPLICATION

This application is a 371 of international application of PCT application serial no. PCT/CN2019/110994, filed on Oct. 14, 2019, which claims the priority benefit of China application no. 201811198400.2 filed on Oct. 15, 2018, no. 201811533440.8 filed on Dec. 14, 2018, and no. 201910347716.1 filed on Apr. 28, 2019. The entirety of each of the above mentioned patent applications is hereby incorporated by reference herein and made a part of this specification.

BACKGROUND

Field of the Disclosure

The disclosure relates to the field of playing card machine, in particular to a playing card machine and a delivery mechanism thereof, and a playing card shuffling method.

Description of Related Art

Playing card is a kind of entertainment that people love. After each round is finished, players need to sort, shuffle and deal cards by themselves. In order to save the time of dealing cards, automatic card dealers have been invented to deal cards. For example, a patent publication of CN201164714Y discloses a four-opening playing card dealing machine, which has a card-arranging cavity. The center of the card-arranging cavity is provided with a card-arranging differential mechanism driven by a card-arranging electric motor, and the circumference of the card-arranging differential mechanism is evenly distributed with four conveying belts connected to a card-dealing mechanism. The conveying belts are driven by a conveying electric motor, one side of each conveying belt is provided with a card-arranging wheel, and the other side of each conveying belt is provided with a stop block matched with the card-arranging wheel which is provided with a spiral deflector rod. The output end of the card-dealing mechanism is provided with a counting optical eye. When the card-dealing machine is in use, messy cards are placed in the card-arranging cavity with their front sides facing downward. The cards are dealt from the four openings after being processed through the card-arranging differential mechanism, the card-arranging wheel, and the card-dealing mechanism. Although the card-dealing machine basically completes the card-shuffling action and card-dealing action, it is inevitable that the players need to collect, organize and flip over the playing cards whose front side and rear side do not face the same direction. As a result, a lot of labor is required during the game, and the waiting time is increased.

A patent publication of CN102580307A discloses a full-automatic poker machine, which includes a mounting bottom plate and a plurality of support legs arranged at the bottom portion of the mounting bottom plate. The mounting bottom plate is provided with a card inlet arranged in the manner of opening in parallel with the table for placing the playing cards, a card cutting and primary card distributing equipment arranged at one end of the card inlet and configured to separate the messy cards primarily, a card sorting and secondary card distributing equipment arranged at the other end of the card cutting and primary card distributing equipment and configured to arrange the playing cards to face the same direction and separate them into single pieces, a card turning and dealing equipment disposed at the other end of the card sorting and secondary card distributing equipment, and configured to organize the single pieces of playing cards which do not face the same direction to face the same direction and deal the cards in accordance with rules, and a card pushing equipment arranged at the other end of the card turning and dealing equipment, and configured to move the playing cards which have been dealt. A card lifting equipment is disposed on one side of the card pushing equipment, and is configured to lift the playing cards to the tabletop. Specifically, the card cutting and primary card distributing equipment realizes the primary card distribution by different rotation speeds of the card-inlet belt and card-distributing belt (the playing cards are separated into several sets with a few pieces). The card sorting and secondary card distributing equipment conveys the playing cards by the secondary distributing belt and realizes card sorting by the card-sorting belt and the auxiliary card-sorting belt disposed on both sides (the playing cards are adjusted to face the same direction, that is, organizing the cards). The card turning equipment realizes turning cards by the card-turning plate and three card-turning belts that are recessed downward (the playing cards are flopped to face a direction as required). The card dealing equipment deals cards randomly by the card-dealing belt and the card-dealing rod (that is, the playing cards are shuffled and dealt). The playing cards that are dealt directly fall on the card-pushing panel and then pushed to the card-lifting panel by the card-pushing rod, and the card lifting equipment lifts the playing cards to the desktop of the game table.

Although the above-mentioned playing card machine basically realizes the actions of sorting, shuffling and dealing cards, they have the following problems due to their structural limitations.

1. The playing cards are easily jammed in the gap between the conveyor belt and the surrounding walls, which may easily cause damage to playing cards, jamming or equipment failure.

2. The playing cards are placed flat on the conveyor belt, and the playing cards are rotated and adjusted in the horizontal plane through the opposite movement of the card sorting belts on both sides, so that the playing cards can be sorted horizontally. However, such design can easily cause the playing cards to float and jammed between the card sorting belts on both sides, and even the playing cards can be damaged or jammed in the gap of the belts. Moreover, there is high requirement for the conveying speed and length of the conveyor belt, and therefore the card sorting efficiency is low.

3. The card turning plate and three card turning belts are cooperated to flop the playing cards. Such design has the shortcomings that the cards cannot be flopped in a stable manner, and the card turning efficiency is low. Meanwhile, the drawback of cards jamming in the gap of the belts still exists.

4. The plurality of card-dealing openings are arranged by using the card dealing belt and straight lines. Such design has the shortcomings that the cards cannot be dealt in a stable manner, and the card dealing efficiency is low. Moreover, the playing cards at multiple positions are lifted at the same position, which makes it inconvenient for the players to take the cards, and the chance of cheating may be increased.

A patent publication of CN103055499A discloses a full-automatic poker machine, including a card feeding frame for placing the playing cards, and a card sending mechanism is disposed at the bottom portion of the card feeding frame and configured to convey the playing cards. A card disposing groove is used for placing the playing cards vertically, and at least two playing card disposing devices are disposed in the card disposing groove and they can generate movement relative to each other, so as to move the playing cards so that the playing cards can be moved out of the card disposing groove with vertical long edges. A vertical card transferring device is configured to vertically place the playing cards that are sent by the card feeding frame in the card disposing groove. A card turning device configured to flop the playing cards to face upward or downward, and the card turning device is disposed at the outlet side of the card disposing groove. A card dealing device is disposed at the rear side of the card turning device, and is configured to randomly send the playing cards to multiple card receptor boxes. Multiple card lifting devices are configured to lift the playing cards in various card receptor boxes to the desktop of the game table. The playing card machine adopts normal playing cards and sorts the cards in a vertical manner, which significantly increases the accuracy and efficiency of card sorting. However, there are many components required for the playing card machine and the manufacturing cost is high.

A patent publication of CN105854274A discloses a poker machine and poker card sorting method thereof, which omits the card sorting device and vertical card transferring device. By arranging a card discharging mechanism at the card outlet of the existing card feeding frame, the card discharging mechanism sends out single pieces of cards which are sent to the card turning device to be flopped and dealt. The machine can separate, flop, shuffle and deal a pile of playing cards which have been organized. The machine has high card shuffling efficiency, good reliability, and the manufacturing cost of the machine is low. However, the card turning device of the playing card machine can only send one mahjong tile to the card turning box at a time for identification, turning and dealing. The card turning efficiency is low, and the noise caused by the rotation in the card turning box is loud, the load of motor is large, the structure is complicated, and the stability is poor. Additionally, the arrangement of the structure of the playing card machine is loose, the volume of the machine is large, and the installing efficiency is low.

SUMMARY

Technical Problem

In order to solve the above problems, the purpose of the disclosure is to provide a playing card machine and a delivery mechanism thereof, and a card shuffling method, which has a simple structure, operates reliably, has high card-dealing efficiency and low error rate.

Technical Solution

To achieve the above purpose, the disclosure adopts the following technical solution.

A playing card machine includes a base and a machine core. The machine core is arranged on the base or inside the base, and the machine core includes a card receptor and a card dealer. The machine core can be driven to move up and down on the base by a machine core lifting drive mechanism. The card dealer is arranged at a center of the card receptor and can be driven by a rotation drive mechanism to rotate relative to the card receptor. The card dealer includes a card storage box, a card distribution mechanism, and a delivery mechanism. The card receptor is provided with multiple card reception positions around the card dealer. The card dealer has a passage for playing cards to pass therethrough, the passage includes the card feeding passage, the delivery passage and the first card discharging passage that are connected in sequence. The card distribution mechanism is installed at the card feeding passage of the card dealer, and the delivery mechanism is installed at the delivery passage of the card dealer. The card distribution mechanism includes a card stopper plate, a card sending wheel, a card distribution wheel and a card distribution press wheel. The card sending wheel is configured to push the playing cards to the card feeding passage of the card dealer and is disposed at a bottom portion of the card storage box. The bottom portion of the card stopper plate is provided with the card distribution press wheel. The card distribution wheel is disposed below the card distribution press wheel. The card distribution wheel is driven to rotate by a card dealing motor. The card distribution press wheel performs non-rotation when cards are fed in and performs rotation when cards are discharged by one-way clutching mechanism. An axis of the card distribution press wheel and an axis of the card distribution wheel are staggered by a horizontal distance, and the axis of the card distribution press wheel is closer to the card storing space of the card storage box than the axis of the card distribution wheel. A bottommost point of the card distribution press wheel is lower than a highest point of the card distribution wheel. The delivery mechanism includes a first delivery wheel and a second delivery wheel disposed on the delivery bottom wall of the delivery passage, and a first delivery press wheel and a second delivery press wheel disposed on the delivery top wall of the delivery passage. The first delivery press wheel and the first delivery wheel operate cooperatively in an up-down manner, and the second delivery press wheel and the second delivery wheel operate cooperatively in an up-down manner. The first delivery press wheel and the second delivery press wheel are driven wheels. The first delivery wheel, the second delivery wheel and the card distribution wheel are in drive transmission with the card dealing motor. Multiple detection components for detecting the playing cards are provided in the delivery passage. The card outlet of the first card discharging passage is provided with a card discharging wheel and a first card discharge pressing wheel thereof. The card discharging wheel is a driving wheel and is in transmission connection with the card dealing motor. The first card discharge pressing wheel that operates cooperatively with the card discharging wheel is a driven wheel.

Preferably, a top portion of the card receptor is provided with a panel having a card placing hole. A door plate is provided on the card placing hole, and the card storage box is provided below the card placing hole. The card receptor and the base are movable up and down relative to each other by cooperation of multiple guide columns and guide sleeves or cooperation of slots and sliding blocks, the guide columns and guide sleeves and the slots and sliding blocks are arranged around the card receptor and the base. Each card reception position is provided with a card pushing plate and a card pushing slot, the card pushing plate is driven to reciprocate from an inner side of the card reception position to an outer side of the card reception position by a card pushing drive mechanism.

Preferably, the card pushing drive mechanism is arranged under the card receptor, and includes a card pushing motor, a card pushing drive member, and a plurality of card pushing swing arms corresponding to the plurality of card pushing plates one-to-one. The card pushing drive member has a circular ring shape, and is disposed at a bottom portion of the card receptor and driven to rotate by the card pushing motor. Multiple drive parts extend from an outer circumference of the card pushing drive member and correspond to the multiple card pushing swing arms one-to-one. One drive part is movably connected to a middle portion of one card pushing swing arm. One end of the card pushing swing arm is movably connected to the bottom portion of the card receptor. The other end of the card pushing swing arm is movably connected to the bottom portion of the card pushing plate. In this way, the card pushing drive member is rotated to push various card pushing swing arms to rotate, and the card pushing plate is pushed to perform card pushing action from the inner side toward the outer side of the card reception position or perform reciprocating action from the outer side toward the inner side of the card reception position.

Preferably, the machine core lifting drive mechanism includes a lifting drive member, a lifting motor, and a plurality of lifting swing arms. The multiple lifting swing arms are evenly distributed under the card receptor of the machine core. One end of the lifting swing arm is hinged with the base, and the other end of the lifting swing arm abuts against a bottom portion of the card receptor of the machine core. The lifting motor is able to drive rotation of the lifting drive member, such that the lifting swing arms are driven to simultaneously swing up and down by the lifting drive member, and that the machine core is lifted and lowered up and down.

Preferably, the card storage box is located on one side of the card dealer, the card distribution mechanism and the delivery mechanism are located on another side of the card dealer, and a side of the bottom portion of the card storage box communicates with the card feeding passage of the card dealer.

Preferably, the card storage box is configured for placement of a pile of playing cards that are organized. The bottom portion of the card storage box is provided with a detection sensor for detecting whether the playing cards are placed therein and the card sending wheel configured to push the playing cards to the card feeding passage of the card dealer. The card stopper plate is formed on a side wall of the card storage box close to the card feeding passage of the card dealer. Multiple card feeding ribs are provided on the card stopper plate. The card distribution wheel of the card dealer is provided under the card feeding ribs. Multiple card feeding protrusions are formed on an inner wall at the bottom portion of the card storage box between the card sending wheel and the card distribution wheel. In this way, the card feeding passage is defined between these card feeding protrusions and the card feeding ribs.

Preferably, the rotation drive mechanism includes a rotating motor installed at the bottom portion of the card receptor and a driven wheel that rotates synchronously with a dealer seat in a fixed circumferential direction. The rotating motor drives the driven wheel through a rotating transmission belt to drive the dealer seat to rotate.

A delivery mechanism of a playing card machine includes a first delivery wheel and a second delivery wheel disposed on the delivery bottom wall of a delivery passage, and a first delivery press wheel and a second delivery press wheel disposed on the delivery top wall of the delivery passage. The first delivery press wheel and the first delivery wheel operate cooperatively in an up-down manner. The second delivery press wheel and the second delivery wheel operate cooperatively in an up-down manner. The first delivery press wheel and the second delivery press wheel are driven wheels. The first delivery wheel, the second delivery wheel and the card distribution wheel are in transmission connection with a card dealing motor. An identification component for identifying front and rear sides of the playing cards and multiple detection components for detecting the playing cards are provided in the delivery passage.

Preferably, the identification component configured to identify the front and rear sides of the playing cards is a camera. The camera and a detection sensor for detecting the presence of the playing cards are fixed on the delivery bottom wall or the delivery top wall of the delivery passage. When the detection sensor detects the playing cards, the camera is activated at the same time or delayedly, and the camera captures the pattern information on a diagonally fixed position of the playing cards in the delivery passage.

Preferably, a value range of a vertical distance M between a lens center of the camera and the left side wall or right side wall of the delivery passage adjacent thereto is: a vertical distance between a character pattern of a playing card and an adjacent side edge of the playing card<M<the vertical distance between the character pattern of a playing card and the adjacent side edge+5 mm. A value range of the vertical distance H between the lens center of the camera and the playing cards in the delivery passage is: 10 mm<H<15 mm.

Preferably, the detection sensor for detecting the presence of the playing cards and the cameras are arranged adjacent to each other in a left-right direction. Two cameras are arranged in the delivery passage, and the two cameras are respectively close to a left side wall and a right side wall of the delivery passage.

Preferably, the multiple detection components for detecting playing cards include a first sensor, a second sensor, and a third sensor that are sequentially installed along a forwarding direction of the playing cards on the delivery top wall or the delivery bottom wall of the delivery passage. The first sensor and the third sensor cooperatively detect a length distance simultaneously covered by the playing cards in the delivery passage to determine whether there is a state that multiple playing cards are overlapped. In the situation where the playing cards are delivered forward with in a direction along a width edge in the card dealing device, a distance between the first sensor and the third sensor is 2 mm to 3 mm larger than the length of the playing cards. In the situation where the playing cards are delivered forward in a direction along a length edge in the card dealing device, the distance between the first sensor and the third sensor is 2 mm to 3 mm larger than the width of the playing cards.

Preferably, the first sensor, the second sensor and the third sensor are photoelectric sensing modules.

A playing card machine includes the abovementioned delivery mechanism of the playing card machine.

A playing card shuffling method is characterized in adopting the abovementioned playing card machine.

Advantageous Effect

The disclosure adopts the above technical scheme, has simple structure, operates reliably, has high card dealing efficiency and low error rate.

DESCRIPTION OF EMBODIMENTS

Figure 1:
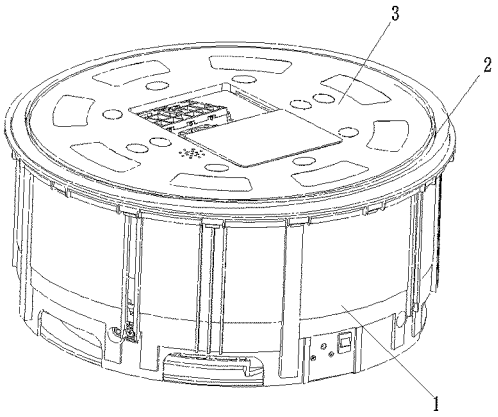
FIG. 1 is a perspective view of the playing card machine in the first embodiment of the disclosure (the machine core is not lifted).

The embodiments of the disclosure are described in detail below. Examples of the embodiments are shown in the accompanying drawings, in which the same or similar reference numerals indicate the same or similar elements or elements with the same or similar functions. The embodiments described below with reference to the accompanying drawings are exemplary, and are intended to explain the disclosure, but should not be construed as a limitation to the disclosure.

In the description of the disclosure, it should be understood that the terms "center", "longitudinal", "transverse", "length", "width", "thickness", "upper", "lower", "front", "rear", "left", "right", "vertical", "horizontal", "top", "bottom", "inner", "clockwise", and "counterclockwise" which denote directions or positional relationships are based on the directions or positional relationships shown in the accompanying drawings, and simply serve to describe the disclosure in a convenient manner and simplify the description, instead of indicating or implying that the denoted device or component must be arranged in a specification direction, structured and operated in a specific direction, and therefore should not be construed as a limitation to the disclosure.

In addition, the terms "first" and "second" are only used for descriptive purposes, and cannot be construed as indicating or implying relative importance or implicitly indicating the number of indicated technical features. Thus, the features defined with "first" and "second" may explicitly or implicitly include one or more of these features. In the description of the disclosure, unless otherwise specified, "plurality of" means two or more than two, unless specifically defined otherwise.

In the disclosure, unless otherwise clearly specified and limited, the terms "installed", "connected", "linked", "fixed" and other terms should be construed in a broad sense, for example, it can be a fixed connection or a detachable connection, or integrally connected; it can be a mechanical connection or an electrical connection; it can be directly connected or indirectly connected through an intermediate medium, and it can be the internal communication between two components. For those of ordinary skill in the art, the specific meaning of the above-mentioned terms in the disclosure can be construed according to specific circumstances.

In the disclosure, unless otherwise clearly defined and defined, the description that the first feature is "above" or "below" the second feature may include direct contact between the first and second features, or may include that the first feature and the second feature are not in direct contact but they are in contact through another feature between them. Moreover, the description that the first feature is "on", "above" and "on top of" the second feature includes that the first feature is located right above and obliquely above the second feature, or merely indicates that the level of the first feature is higher than that of the second feature. The description that the first feature is "under", "below" and "beneath" the second feature includes that the first feature is located directly below and obliquely below the second feature, or simply means that the level of the first feature is lower than the second feature.

First Embodiment

A playing card machine as shown in FIG. 1 to FIG. 4 includes a base 1 and a machine core. The machine core is arranged on the base or inside the base, and the machine core includes a card receptor 2 and a card dealer. The machine core can be driven to move up or down on the base 1 by a machine core lifting drive mechanism. The card dealer is arranged at a center of the card receptor 2 and can be driven by a rotation drive mechanism to rotate relative to the card receptor 2. The card dealer includes a card storage box 41 and a card dealing device 42. Multiple card reception positions are provided around the card dealer on the card receptor 2. A panel 3 is provided on a top portion of the card receptor 2. A card placing hole is provided on the panel 3. A door plate 31 and a drive mechanism thereof are mounted on the card placing hole, and the card storage box 41 is provided under the card placing hole.

Figure 2:
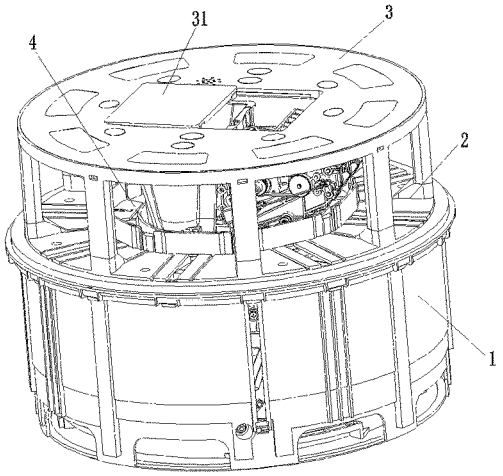
FIG. 2 is a perspective view of the playing card machine in the first embodiment of the disclosure (the machine core is raised).
Figure 3:
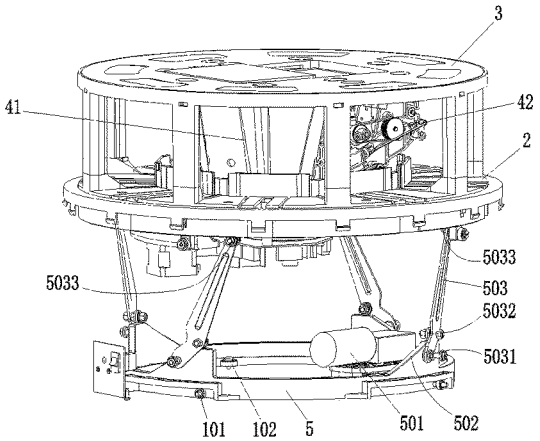
FIG. 3 is a perspective view of the playing card machine in the first embodiment of the disclosure (the machine core is raised, the base is omitted).
Figure 4:
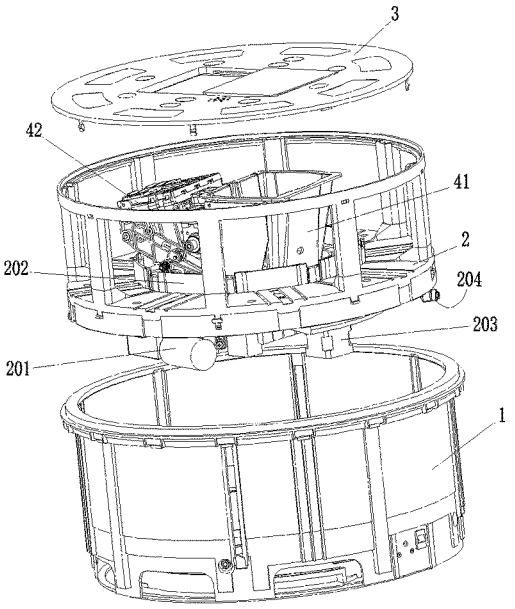
FIG. 4 is an exploded view of the playing card machine in the first embodiment of the disclosure.

As shown in FIG. 2 and FIG. 3, in this embodiment, the base 1 includes a circular bottom plate and a barrel-shaped side wall. A power supply and a power switch thereof are installed on the base. A lifting drive mechanism configured for driving the machine core is disposed on the base. The distributed playing cards are placed on the card receptor 2 of the machine core.

The playing card machine can be placed on the desktop as an independent machine for players to use. In this scenario, the playing card machine may not have a lifting drive mechanism (the base and the card receptor are integrated as a whole), but multiple openings are provided on the side wall of the base for the players to take the playing cards. Most of the time, this playing card machine is embedded in the center hole of the game table, only the panel 3 is exposed and is flush with the desktop, so that the panel will not interfere with the player's playing cards. Meanwhile, the playing card machine can be easily manufactured, configured, and maintained. In this scenario, a lifting drive mechanism needs to be provided on the base to drive the distributed playing cards of all parties to rise so that the players can take the playing cards. It should be noted that the base and the card receptor of the disclosure are not limited to a cylindrical shape, and can also be square column, polygonal column, quincunx, frustum, and other shapes.

In this embodiment, the panel 3 is provided with buttons for controlling actions such as turning on machine, shuffling, dealing cards, and moving the machine core up and down. During the card game, the player can set game rules on the control panel. The playing card machine distributes cards to each player according to the set game rules. When the cards are distributed, the rotation drive mechanism drives the card dealer to rotate and randomly distribute the cards to each player. The cards are intermittently distributed to the card reception position of each player on the card receptor according to the number of cards set by the player. The door plate 31 and its drive mechanism are installed on the panel 3. Reference to the door plate 31 and its drive mechanism can be derived from various structures disclosed in a series of patent publication of CN103157272 and CN108525278.

As shown in FIG. 3 to FIG. 8, in this embodiment, the card receptor 2 and the base 1 are not fixed and can be moved up and down. By arranging multiple guide columns and guide sleeves or slots and sliding blocks that operate cooperatively around the card receptor and the base, up-down guidance can be realized. A plurality of guide rollers 204, which are provided around the card receptor 2, operate cooperatively with the guide groove on the side wall of the base 1 to realize up-down guidance of the card receptor 2. The panel 3 is fixed on the top portion of the card receptor 2. There are multiple openings on the side walls around the card receptor 2. When the card receptor 2 drops to the bottom, the panel 3 is aligned with the desktop of the game table. When the card receptor 2 is completely lifted, the bottom wall of the multiple openings on the side walls around the card receptor 2 is aligned with the desktop of the game table. The card dealer is installed in the center of the card receptor. A plurality of card reception positions are arranged around the card dealer on the card receptor 2. The card reception positions correspond to the openings, and each of the card reception positions is provided with a card pushing plate 202 and a card pushing slot 21. The card pushing plate 202 is driven by the card pushing drive mechanism to reciprocate from the inner side to the outer side of the card reception position. When the card dealer is dealing cards, the card pushing plate 202 moves to the inner side of the card reception position close to the card dealer, and the playing cards are sent to the card reception position. When the machine core is raised to the desktop, the card pushing plate 202 moves from inside to outside along the card pushing slot 21, and pushes the playing cards at the card reception positions out of the machine core to the desktop. The card pushing slot 21 extends to the outer side from the inner side of the card reception position. The card pushing slot 21 is preferably arranged radially along the circumference of the card receptor.

Figure 20:
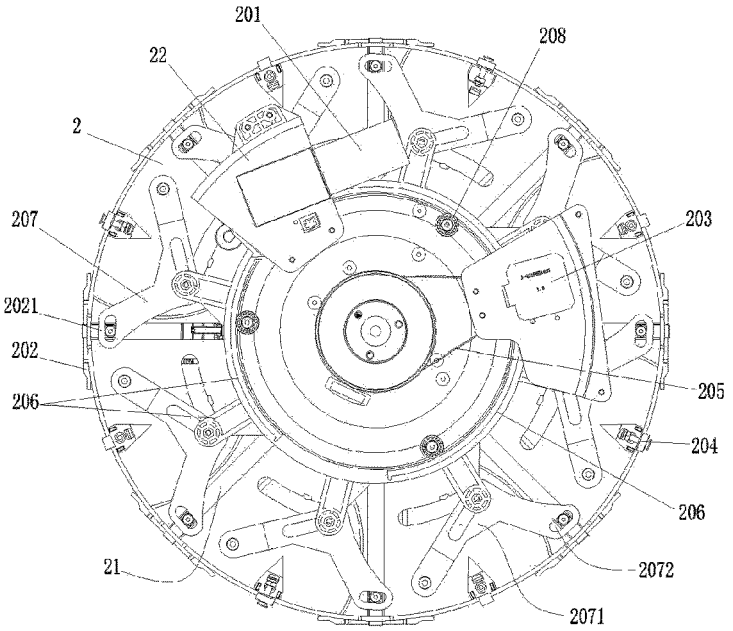
FIG. 20 is a bottom view of the bottom portion of the card receptor in the first embodiment of the disclosure (the card pushing plate has performed the pushing action).
Figure 21:
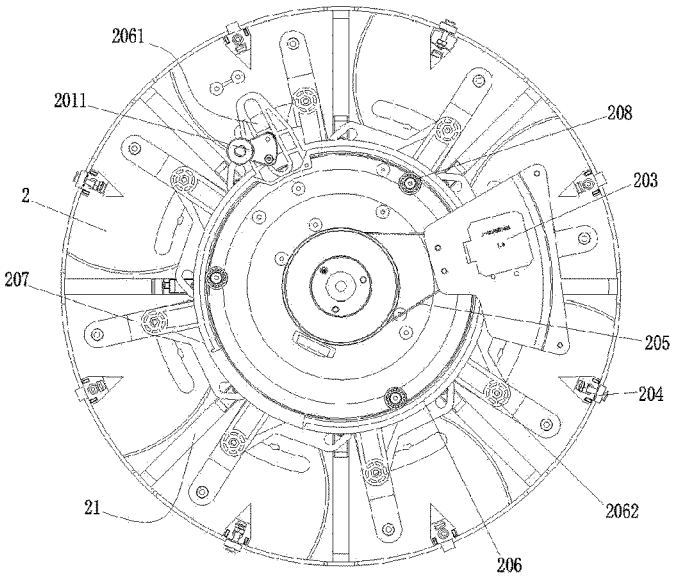
FIG. 21 is a bottom view of the bottom portion of the card receptor in the first embodiment of the disclosure (the card pushing plate has not performed the pushing action).

As shown in FIG. 20 and FIG. 21, the card pushing drive mechanism is arranged under the card receptor 2, and includes a card pushing motor 201, a card pushing drive member 206, and a plurality of card pushing swing arms 207 corresponding to the plurality of card pushing plates 202 one-to-one. The card pushing drive member 206 has a circular ring shape. The card pushing drive member 206 is installed on the bottom portion of the card receptor 2 through a plurality of positioning rollers B208 and is driven to rotate by the card pushing motor 201. Multiple drive parts extend from an outer circumference of the card pushing drive member 206 and correspond to the multiple card pushing swing arms 207 one-to-one. One drive part is movably connected to the middle portion of one card pushing swing arm 207 through the slot A2071. One end of the card pushing swing arm 207 is movably connected (hinged) to the bottom portion of the card receptor 2. The other end of the card pushing swing arm 207 is movably connected to the bottom portion of the card pushing plate 202 through the slot B2072 and the card pushing roller 2021. In this way, the card pushing drive member 206 is rotatable to push various card pushing swing arms 207 to rotate, and the card pushing plate 202 is pushed to perform card pushing action from the inner side of the card reception position toward the outer side, or to perform reciprocating action from the outer side of the card reception position toward the inner side. Such card pushing drive member simultaneously drives the multiple card pushing plates, has a simple structure, performs reasonable actions, operates reliably, and has a low manufacturing cost. The card pushing swing arm 207 is in the shape of a V-shaped boomerang. The card pushing motor 201 drives the card pushing drive member 206 to rotate through the engagement structure of gear and gear ring, or the card pushing motor 201 drives the card pushing drive member 206 to rotate through the engagement structure of the card pushing cam 2011 and the slot 2061.

Figure 6:
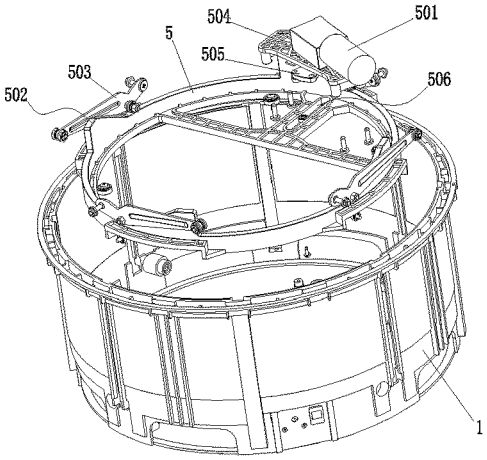
FIG. 6 is an exploded view of the base and the machine core lifting mechanism in the first embodiment of the disclosure.
Figure 7:
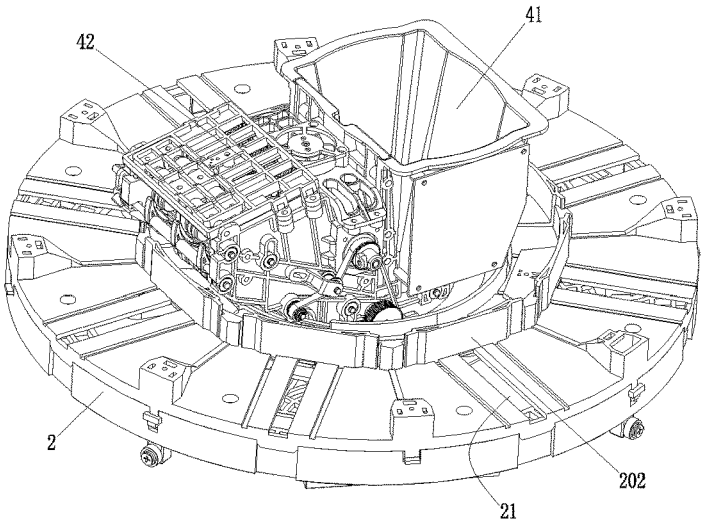
FIG. 7 is a perspective view of the machine core of the playing card machine in the first embodiment of the disclosure (the card pushing plate has not performed pushing action).
Figure 8:
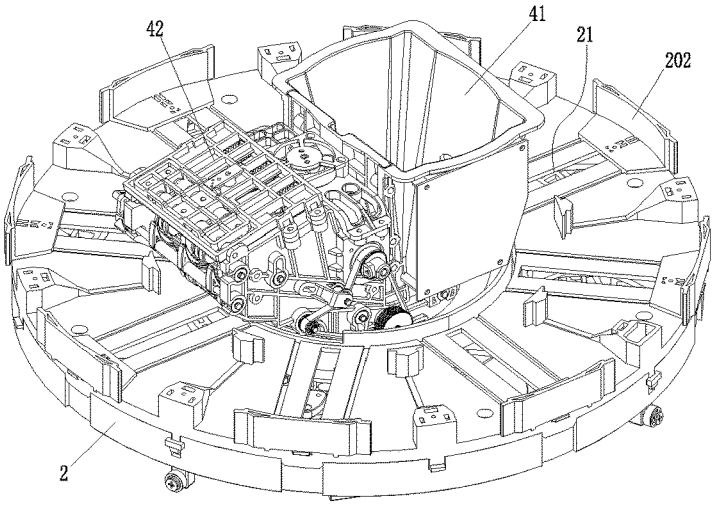
FIG. 8 is a perspective view of the machine core of the playing card machine in the first embodiment of the disclosure (the card pushing plate has performed pushing action).
Figure 22:
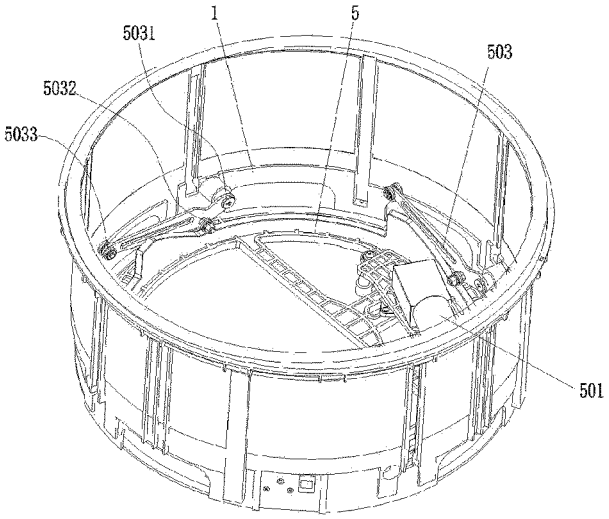
FIG. 22 is a schematic view of the structure of the base in the first embodiment of the disclosure.
Figure 23:
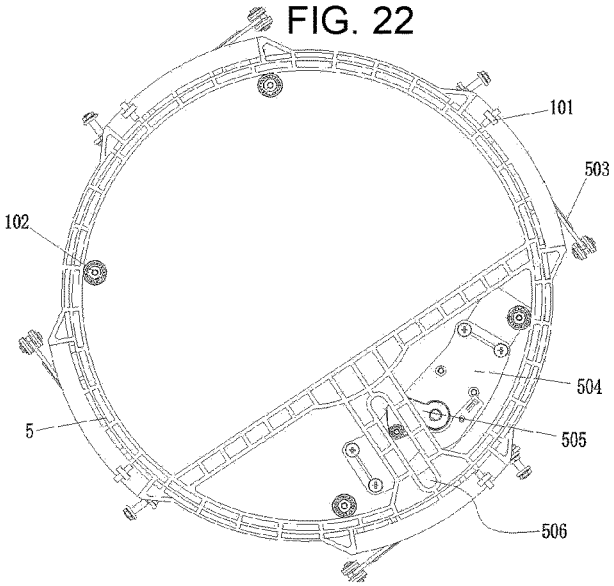
FIG. 23 is a schematic view of the structure of the machine core lifting drive mechanism in the first embodiment of the disclosure.

As shown in FIG. 3 and FIG. 6, the machine core lifting drive mechanism includes a lifting drive member 5, a lifting motor 501, and a plurality of lifting swing arms 503. The plurality of lifting swing arms 503 are evenly distributed under the card receptor 2 of the machine core. One end of the lifting swing arm 503 is hinged with the base 1, and the other end 5033 of the lifting swing arm 503 abuts against the bottom portion of the card receptor 2 of the machine core. The lifting swing arm 503 is driven by the lifting motor 501 through the lifting drive member 5 to simultaneously swing up and down to move the machine core up and down. In this embodiment, the lifting drive member 5 has a circular ring shape, and the top portion of the circumference of the ring is provided with a plurality of lifting protrusions 502 corresponding to the plurality of lifting swing arms 503. The lifting protrusions 502 abut against the middle support rollers 5032 of the lifting swing arms 503. The lifting drive member 5 is installed on the base 1 through the support roller 101 and the positioning roller 102 and can rotate around the center of rotation. In this embodiment, a plurality of support rollers 101 are arranged outside the circular ring of the lifting drive member. A recess which operates cooperatively with the support roller is provided on the lifting drive member, so as to limit the rotation range of the lifting drive member 5. A plurality of positioning rollers 102 are installed on the inner side of the circular ring of the lifting drive member 5, so as to position the rotation center of the lifting drive member. When the lifting drive member 5 rotates under the driving of the lifting motor 501, the middle support rollers 5032 on the plurality of lifting swing arms 503 respectively move along the corresponding lifting protrusions 502 on the lifting drive member 5, so that the lifting protrusions 502 push the lifting swing arms 503 to swing, so that one end 5033 of the lifting swing arm 503 abutting against the bottom portion of the machine core move up and down, that is, the effect of moving the machine core up and down can be realized. As shown in FIG. 22 and FIG. 23, in this embodiment, the lifting motor 501 is installed on the base 1 through the lifting motor bracket 504. The output shaft (or the output shaft of the decelerating mechanism connected to the lifting motor) of the lifting motor 501 is provided with the lifting cam 505 that rotates horizontally. On the lifting cam 505, through the rolling operation between the roller and the lifting slide slot 506 on the lifting drive member 5, the lifting drive member 5 is driven to rotate. In other embodiments, the lifting motor can further drive the lifting drive member to rotate through a driving gear and a gear ring which are engaged internally or externally.

Figure 5:
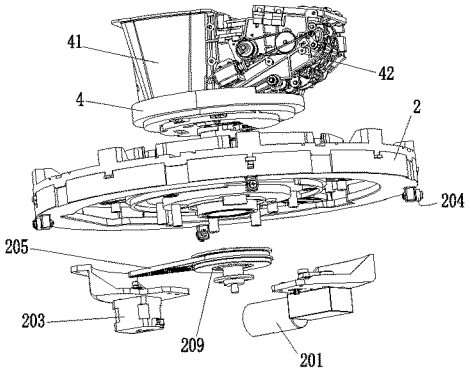
FIG. 5 is an exploded view of the machine core of the playing card machine in the first embodiment of the disclosure.
Figure 9:
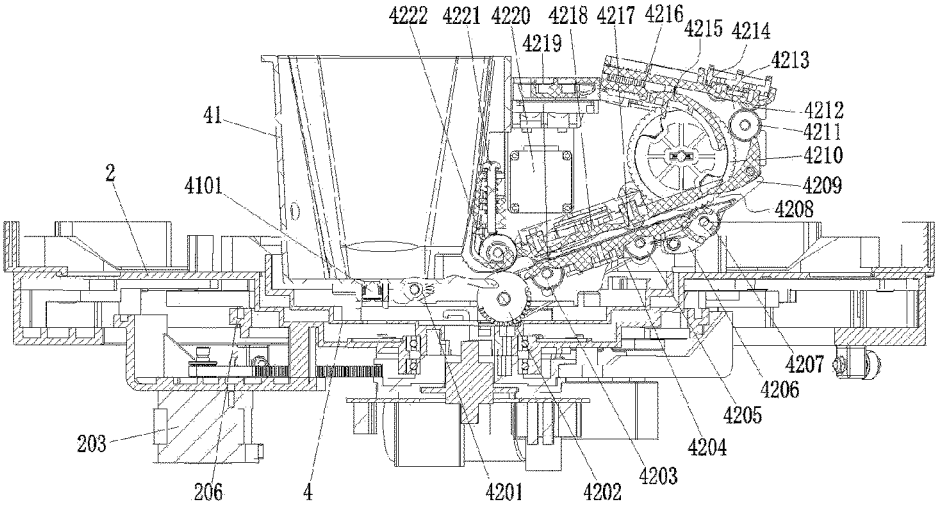
FIG. 9 is a cross-sectional view of the machine core of the playing card machine in the first embodiment of the disclosure.
Figure 10:
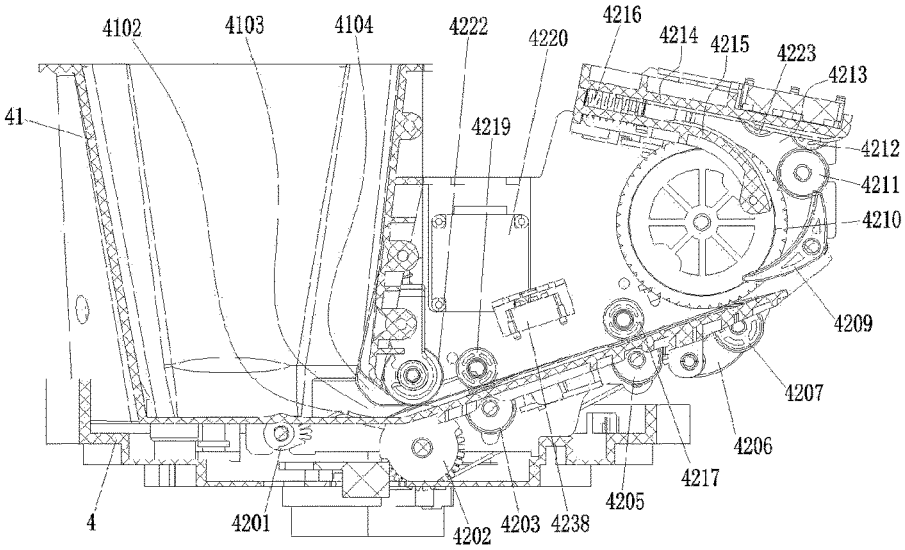
FIG. 10 is a first cross-sectional view of the card dealer in the first embodiment of the disclosure (the state of dealing cards directly).

As shown in FIG. 4, FIG. 5, FIG. 7, and FIG. 8, the card dealer is fixed on the dealer seat 4. The dealer seat 4 is installed in the center of the upper part of the card receptor 2 through a bearing rotation, and is driven to rotate by a rotation drive mechanism. As shown in FIG. 5 and FIG. 9, the rotation drive mechanism includes a rotating motor 203 installed at the bottom portion of the card receptor 2 and a driven wheel 209 that rotates synchronously with the dealer seat 4 in a fixed circumferential direction. The rotating motor 203 drives the driven wheel 209 through the rotating transmission belt 205 and thus driving the dealer seat 4 to rotate.

As shown in FIG. 9 to FIG. 15, the card dealer includes a card storage box 41 and a card dealing device 42. The card storage box 41 and the card dealing device 42 are respectively located on the left and right sides of the dealer seat 4, and one side of the bottom portion of the card storage box 41 is in communication with the card feeding passage of the card dealing device 42. In the embodiment, the card storage box is configured for placement of a pile of playing cards that are organized. The bottom portion of the card storage box 41 is provided with a detection sensor 4101 for detecting whether the playing cards are placed therein and the card sending wheel 4201 configured to push the playing cards to the card feeding passage of the card dealing device 42. A card stopper plate 4105 is formed on a side wall of the card storage box 41 close to the card feeding passage of the card dealing device 42. Multiple card feeding ribs 4104 are provided on the card stopper plate 4105. The card distribution wheel 4202 of the card dealing device 42 is provided under the card feeding ribs 4104. Multiple card feeding protrusions 4102 are formed on an inner wall at the bottom portion of the card storage box 41 between the card sending wheel 4201 and the card distribution wheel 4202. In this way, the card feeding passage 4103 is defined between these card feeding protrusions 4102 and the card feeding ribs 4104. Such card feeding passage with protruding and recessed structures helps to separate the multiple overlapping playing cards through squeezing and rubbing. Further preferably, a plurality of card feeding protrusions 4102 and a plurality of card feeding ribs 4104 are alternately arranged in a staggered manner to achieve a better card rubbing and separating effect.

The card dealing device 42 includes a card distribution mechanism, a delivery mechanism, and a card turning mechanism. The passages for playing cards to pass therethrough in the card dealing device 42 includes the card feeding passage 4103, the delivery passage, the card turning passage 4224, the first card discharging passage 4208, and the second card discharging passage 4213. Near the first card discharging passage 4208, there is a card turning component 4209 for opening or closing the card turning passage 4224 or the outlet of the first card discharging passage 4208. When the card turning component 4209 closes the card turning passage 4224 or opens the outlet of the first card discharging passage 4208, the card feeding passage 4103, the delivery passage, and the first card discharging passage 4208 are connected in sequence. When the card turning component 4209 opens the card turning passage 4224 and closes the outlet of the first card discharging passage 4208, the card feeding passage 4103, the delivery passage, the first card discharging passage 4208, the card turning passage 4224, and the second card discharging passage 4213 are connected in sequence. The card distribution mechanism is installed at the card feeding passage of the card dealing device 42, the delivery mechanism is installed at the position of the delivery passage, and the card turning mechanism is installed between the first card discharging passage 4208 and the second card discharging passage 4213.

The card distribution mechanism can adopt various card distribution structures disclosed in a series of patent publication of CN108525278A and CN105854274A, etc. However, although these card distribution structures can better separate the fed playing cards to ensure single pieces of them to pass therethrough, it is difficult to make the playing cards that have been fed into the delivery passage to be withdrawn (card withdrawal) from the card feeding passage. Once the above situation occurs, when the sensor subsequently detects that two playing cards are overlapped and it is necessary to withdraw the overlapped playing cards from the notification of card sending for further card separation, the difficulty of card withdrawal will occur. In order to overcome this technical problem, in this embodiment, the card separating mechanism preferably has the following structure.

As shown in FIG. 9 to FIG. 12, a card stopper plate 4105, a card sending wheel 4201, a card distribution wheel 4202, and a card distribution press wheel 4222 are included. The card sending wheel 4201 configured for pushing the playing cards to the card feeding passage of the card dealing device 42 is disposed at the bottom portion of the card storage box 41. The card distribution press wheel 4222 is disposed at the bottom portion of the card stopper plate 4105. The card distribution wheel 4202 is disposed under the card distribution press wheel 4222. The card distribution wheel 4202 is driven by the card dealing motor to rotate. The card distribution press wheel 4222 performs non-rotation when cards are fed in and performs rotation when cards are discharged by one-way clutching mechanism. In this way, not only that the cards can be quickly and effectively distributed when the cards are fed in, when the cards need to be withdrawn, the card distribution press wheel 4222 can operate cooperatively with the card distribution wheel 4202 to rotate reversely, thereby realizing card withdrawal quickly and reliably, thus prevent card withdrawing problem. Further preferably, the card distribution press wheel 4222 and the card distribution wheel 4202 are designed to be misaligned in the front-rear direction and overlapped in the up-down direction (that is, the axis of the card distribution press wheel 4222 and the axis of the card distribution wheel 4202 are staggered by a horizontal distance, and the axis of the card distribution press wheel 4222 is closer to the card storing space of the card storage box 41 than the axis of the card distribution wheel 4202, the bottommost point of the card distribution press wheel 4222 is lower than the highest point of the card distribution wheel 4202). In this way, when multiple playing cards enter the gap between the card distribution press wheel 4222 and the card distribution wheel 4202, the feeding end of the playing cards will be cocked, so that the two overlapped playing cards are misaligned, thus preventing them from being adhered together electrostatically and cannot be separated. Since the card distribution press wheel 4222 is controlled by the one-way clutching mechanism and cannot be rotated, the static friction between the card distribution press wheel 4222 and the playing card on the top is much greater than the friction between the two overlapped playing cards. Moreover, the delivery force of the playing cards is applied by the card distribution wheel 4202 and applied to the playing card underneath. Therefore, the playing card underneath is delivered to move forward continuously, and the playing card at the top is retained temporarily. The two overlapped playing cards are separated quickly, the structure is simple, maintenance is easy, and accuracy is high.

In order to further enhance the card distribution effect of the card distribution mechanism, the bottom portion of the card stopper plate 4105 is provided with a number of card feeding ribs 4104, and a number of card feeding protrusions 4102 are formed on the inner wall of the bottom portion of the card storage box 41 between the card sending wheel 4201 and the card distribution wheel 4202. The card feeding rib 4104 is closer to the card distribution press wheel 4222 than the card feeding protrusion 4102, so that the card feeding passage 4103 of the card dealing device 42 is formed among the card feeding protrusion 4102, the card feeding rib 4104 and the card distribution wheel 4202. The card feeding passage 4103 has protruding structures at two ends (card feeding protrusion 4102 and card distribution wheel 4202) and a recessed structure at the middle part. In this way, the card feeding passage with protruding and recessed structures helps to separate the multiple overlapped playing cards by squeezing and rubbing, thereby ensuring that the multiple playing cards entering the position of card distribution wheel 4202 and card distribution press wheel 4222 are separated and staggered. In addition, because the card feeding protrusion 4102 will lift the playing cards in the card storage box 41 out of the card feeding passage 4103, when the cards are withdrawn, the playing cards withdrawn from the card feeding passage will be inserted under the playing cards in the card storage box 41, so as to avoid the difficulty of pushing cards due to two playing cards abutting against each other. Further preferably, a plurality of card feeding protrusions 4102 and a plurality of card feeding ribs 4104 are arranged alternately to achieve a better card separating effect.

Figure 16:
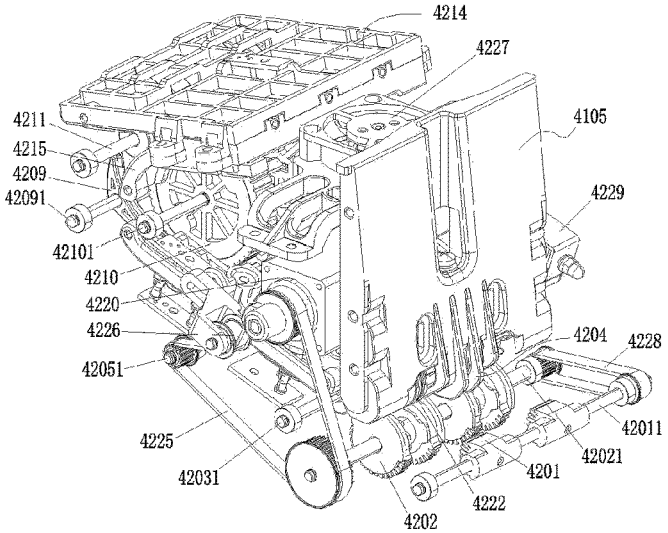
FIG. 16 is a first perspective view of the card dealing device in the first embodiment of the disclosure (part of the housing is omitted).
Figure 17:
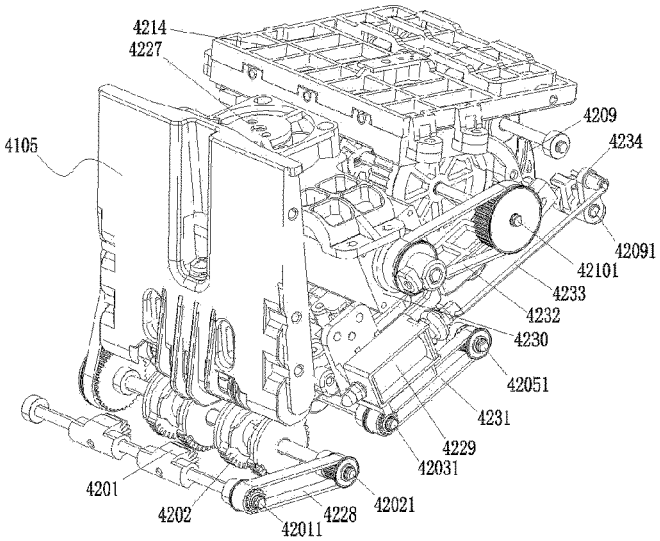
FIG. 17 is a second perspective view of the card dealing device in the first embodiment of the disclosure (part of the housing is omitted).
Figure 18:
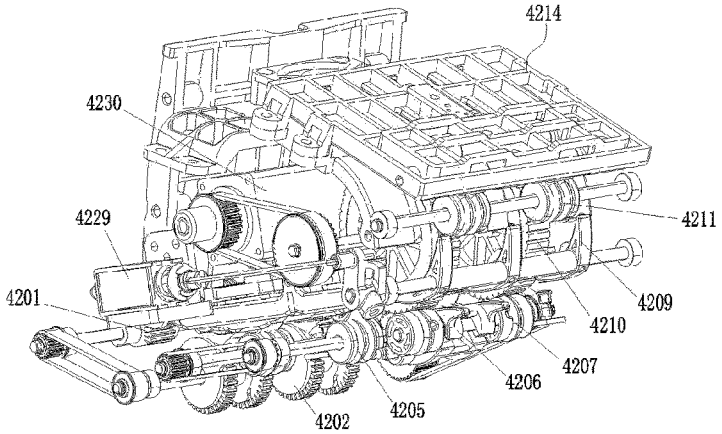
FIG. 18 is a third perspective view of the card dealing device in the first embodiment of the disclosure (part of the housing is omitted).

In this embodiment, one side of the card sending wheel 4201 is protrudingly formed with arc-shaped teeth, so that the playing cards can be pushed up and forward during the rotation of the card sending wheel 4201, and therefore the playing cards can better cross the card feeding protrusion 4102. In addition, performing this action can also avoid that the playing cards abutting against each other from being jammed when the card dealing device withdraws the cards. The card distribution press wheel 4222 passively rotates in one direction. In order to facilitate adjustment, the card distribution press wheel 4222 is installed at the bottom portion of the card stopper plate 4105 through an elastic pressing mechanism. The elastic pressing mechanism is a compression spring and a top rod 4221, a one-way clutching mechanism is a one-way clutch mounted on the shaft of the card distribution press wheel 4222. Each of the card distribution wheel, the card sending wheel, and the card distribution press wheel can be a roller part, or can be composed of multiple wheel-shaped parts mounted on the same shaft. For example, as shown in FIG. 16 and FIG. 17, each card distribution wheel 4202 includes a support frame with a certain rigidity and a rubber ring sleeved and fixed on the support frame. Part of the arc-shaped circumference of the rubber ring is a protruding arc-shaped rubber tooth configured to be in contact with the playing cards. The circumference excluding the arc-shaped rubber tooth of the rubber ring is lower than the circumference of the side wall of the support frame. In this way, when the arc-shaped rubber tooth of the card distribution wheel comes into contact partially with the playing cards, the friction is greater and it is easier to drive the playing cards to move. When the side wall circumference of the support frame of the card distribution wheel contacts the playing cards, the friction is small and it is difficult to drive the playing cards to move. By moving the playing cards at intervals, it helps to separate two playing cards. Four card distribution wheels 4202 are installed on the same card distribution axle 42021. The card feeding rib 4104 and card distribution press wheel 4222 at the bottom portion of the card stopper plate 4105 and the four card distribution wheels 4202 are arranged alternately in up-down direction, which is convenient for adjusting the gaps in the up-down direction, thereby realizing card distribution quickly and effectively. The card sending axle 42011 of the card sending wheel 4201 and the card distribution axle 42021 of the card distribution wheel 4202 are in transmission connection through the card feeding transmission belt 4228, so as to realize the cooperative rotation of the card sending wheel 4201 and the card distribution wheel 4202, thereby improving the card distribution efficiency and the card distribution effect.

As shown in FIG. 9 to FIG. 12, the delivery mechanism includes the first delivery wheel 4203 and the second delivery wheel 4205 installed on the delivery bottom wall 4204 of the delivery passage, and the first delivery press wheel 4219 and the second delivery press wheel 4217 installed on the delivery top wall 4218 of the delivery passage. The first delivery press wheel 4219 and the first delivery wheel 4203 operate cooperatively in up-down direction, and the second delivery press wheel 4217 and the second delivery wheel 4205 operate cooperatively in up-down direction. The first delivery press wheel 4219 and the second delivery press wheel 4217 are driven wheels, and the first delivery wheel 4203 and the second delivery wheel 4205 are driving wheels and are covered with rubber rings to increase friction. The first delivery axle 42031 of the first delivery wheel 4203, the second delivery axle 42051 of the second delivery wheel 4205, and the card distribution axle 4202 of the card distribution wheel 4202 and the card dealing motor shaft 42201 of the card dealing motor 4220 are in transmission connection through the card dealing transmission belt 4225. The card dealing transmission belt 4225 is tensioned through the tensioning wheel 4226, thus realizing the synchronous movement of card feeding, card distribution and card delivery. These parts, including the first delivery wheel 4203, the second delivery wheel 4205, the first delivery press wheel 4219, and the second delivery press wheel 4217, can be press-fitted in up-down direction, or staggered and misaligned in up-down direction. Each of the parts can be a roller part, or can be composed of multiple wheel-shaped parts mounted on the same shaft.

Figure 13:
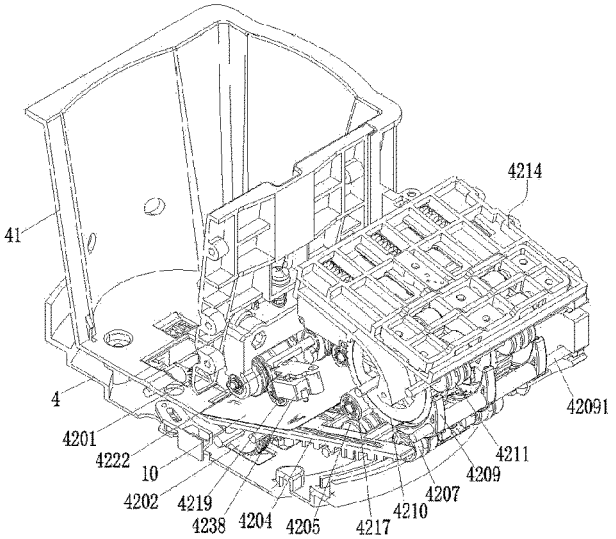
FIG. 13 is a partial cross-sectional perspective view of the card dealer in the first embodiment of the disclosure.
Figure 14:
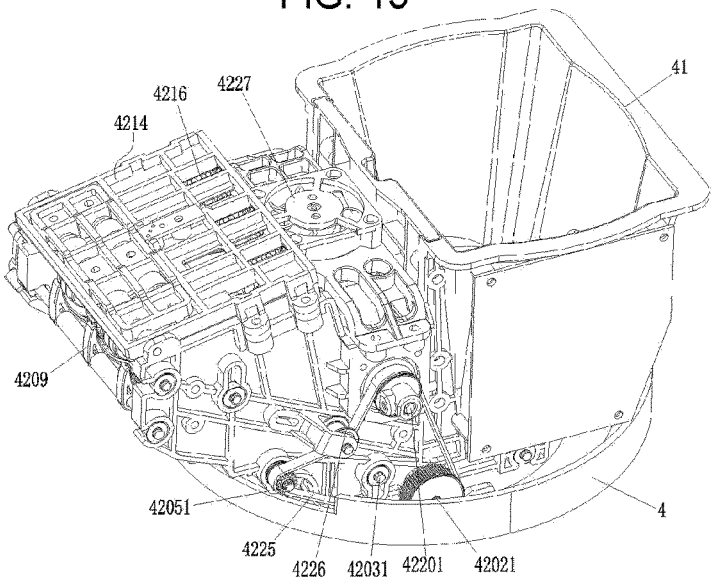
FIG. 14 is a first perspective view of the card dealer in the first embodiment of the disclosure.
Figure 19:
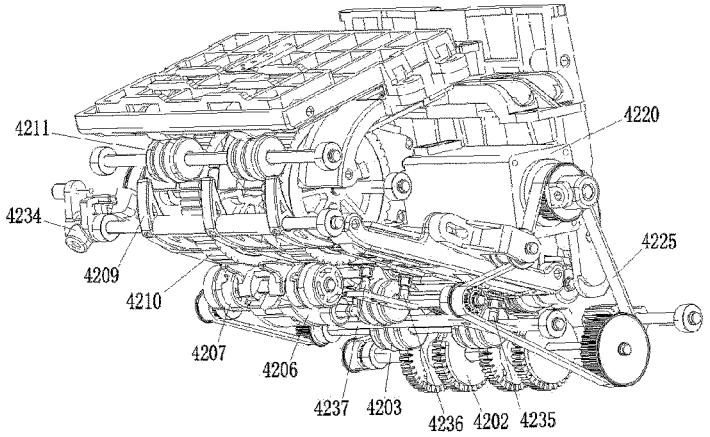
FIG. 19 is a fourth perspective view of the card dealing device in the first embodiment of the disclosure (part of the housing is omitted).

As shown in FIG. 13 and FIG. 19, the delivery passage of the card dealer is provided with an identification component for identifying the front side and rear side of a playing card and a plurality of detection components for detecting the playing card.

Regarding the identification of the front and rear sides of the playing cards in the delivery passage, one method is to obtain the photo information of different positions on the same side of the playing cards. By utilizing the regularity that the pattern on the rear side of the playing card is a unit pattern which has continuousness at four sides with high coincidence, it can be determined whether a side of the playing card is the front side or rear side according to the coincidence level of the pattern in the photos. Another method is to identify the front and rear sides of the playing card by distinguishing the character pattern on the diagonal fixed position of the playing card based on the characteristic that there must be a character at the fixed position on the diagonal corner on the front side of the playing card. One example is Kou Yongjun's master's thesis titled "Application Research on Image Recognition on Card Dealing Machine" published in Hunan University Journal in 2007. Another method is to print magnetic ink at a fixed position on the front side or rear side of the playing card, and identify the front side and rear side of the playing card by detecting the magnetic ink. In the first two identification methods, the identification component is a camera. In the third identification method, the identification component is a magnetic detection sensor.

Regarding identifying whether the playing cards in the delivery passage overlap each other, one method is to detect the length of the playing cards. When the detection component detects that the playing cards in the delivery passage are longer than the normal length, it can be determined that there are multiple playing cards overlapping each other. Another method is to detect the thickness of the playing cards. When the detection component detects that the thickness of the playing cards in the card feeding passage, the delivery passage, or the first card discharging passage is greater than the normal thickness, it can be determined that there are multiple playing cards overlapping each other. One or more methods can be adopted in the same card dealing device.

When it is identified that the playing cards in the delivery passage do not need to be flipped over, the card turning mechanism will deal the playing cards directly. When it is identified that the playing cards in the delivery passage need to be flipped over, the card turning mechanism will flip the playing cards over and deal it. When it is identified that the playing card needs to be withdrawn from the card dealing device, the card dealing motor 4220 drives the first delivery wheel 4203, the second delivery wheel 4205, the card distribution wheel 4202, and the card sending wheel 4201 to reverse so as to implement card withdrawal. One or more methods can be adopted in the same card dealing device.

The disclosure identifies the front and rear sides of the playing cards in the delivery passage, and flips the playing cards over in the card turning passage. The two steps do not conflict with each other, and the cards can be flopped and dealt continuously, which greatly improves card turning efficiency and card dealing efficiency.

As shown in FIG. 13, in this embodiment, the identification component used to identify the front and rear sides of the playing card is a camera 4238. The camera 4238 and a detection sensor for detecting the presence of playing cards are fixed on the delivery bottom wall 4204 or the delivery top wall 4218 of the delivery passage. When the detection sensor detects a playing card, the camera is activated simultaneously or delayedly, so that the camera can capture the pattern information on the diagonal fixed position of the playing card in the delivery passage right on time. In this way, the controller can identify the front and rear sides of a playing card according to the pattern information. For example, when a character pattern is identified, it is determined that the side is a front side of the playing card.

In order to ensure that the camera can be activated in time and capture a panoramic view of the character patterns on the playing cards, it is preferably set as follows.

In the first case, the playing cards are delivered forward in a direction along the width side in the card dealing device (that is, the width of the delivery passage is close to the width of the playing cards). In this way, the preferred value range of the width B of the delivery passage is: playing card width+1 mm<B<playing card width+5 mm.

The value range of the vertical distance M between a lens center of the camera and the left side wall or right side wall of the delivery passage adjacent to the lens center of the camera is: the vertical distance between the character pattern of a playing card and an adjacent side edge of the playing card<M<the vertical distance between the character pattern of a playing card and the adjacent side edge of the playing card+5 mm.

The value range of the vertical distance H between the lens center of the camera and the playing cards in the delivery passage is: 10 mm<H<15 mm.

Take the commonly used playing cards (BridgeSize length 8.8 cm width 5.7 cm) as an example, the value ranges are 58 mm<B<62 mm, and 6 mm<M<12 mm.

In the second case, the playing cards are delivered forwards along the length side in the card dealing device (that is, the width of the delivery passage is close to the length of the playing cards). In this way, the preferred value range of the width B of the delivery passage is: playing card length+1 mm<B<playing card length+5 mm.

The value range of the vertical distance M between the lens center of the camera and the left side wall or right side wall of the delivery passage adjacent to the lens center of the camera is: the vertical distance between the character pattern of a playing card and the adjacent side edge of the playing card<M<the vertical distance between the character pattern of a playing card and the adjacent side edge of the playing card+5 mm.

The value range of the vertical distance H between the lens center of the camera and the playing cards in the delivery passage is: 10 mm<H<15 mm.

Take the commonly used playing cards (BridgeSize length 8.8 cm width 5.7 cm) as an example, 89 mm<B<93 mm, 6 mm<M<12 mm.

In other embodiments, the playing cards in the delivery passage can be delivered closer to the edge to the left side or right side through a specific delivery method, speed and direction, so that the width of the delivery passage will not be in conflict with the arrangement of the camera, and only the following is required to be defined. The value range of the vertical distance M between the lens center of the camera and the left side wall or right side wall of its adjacent delivery passage is: the vertical distance between the character pattern of a playing card and its adjacent side edge<M<the vertical distance between the character pattern of the playing card and its adjacent side edge+5 mm. Take the commonly used playing cards (BridgeSize length 8.8 cm width 5.7 cm) as an example, 6 mm<M<12 mm. The value range of the vertical distance H between the lens center of the camera and the playing cards in the delivery passage is: 10 mm<H<15 mm.

In this way, not only it is possible to prevent unnecessary scratching and obstruction generated between the playing cards and the side walls of the delivery passage, but also it can be ensured that the camera can still capture a panoramic view of the position of the character on the playing card when the playing card is tilted in the delivery passage.

In addition, in order to avoid or reduce the influence of uncertain factors such as the forwarding speed of playing cards in the delivery passage, it is preferable to set the detection sensor used for detecting the presence of the playing cards and the camera 4238 adjacent to each other in the left-right direction, so that after the detection sensor detects that the playing cards are in place, the camera can be activated immediately to capture the panoramic view of the position of the character on the playing card. In other embodiments, it may also be preferable to provide two cameras in the delivery passage. The two cameras are respectively close to the left side wall and right side wall of the delivery passage. Multiple cameras are used for capturing images and identification to improve accuracy and identification efficiency of identifying the front side and rear side of the playing cards.

It should be noted that the width of the delivery passage refers to the effective width which enables the playing cards to be delivered. The left side wall or right side wall of the delivery passage refers to the theoretical left side wall or right side wall of the effective width. In an implementable embodiment, the left side wall or right side wall of the delivery passage may be a visible structure formed by a position-limiting part, a position-limiting structure, a housing wall surface, etc., or a non-visible structure but actually exists, for example, by controlling the delivery method, speed and direction of the delivery wheel/roller, and other methods to limit the range where the playing cards can be delivered to within a specification range in the delivery passage, and the left and right boundaries of the specific range are regarded as the left side wall or right side wall of the delivery passage.

As shown in FIG. 19, in this embodiment, the delivery top wall 4218 or the delivery bottom wall 4204 of the delivery passage is provided with a first sensor 4235, a second sensor 4236, and a third sensor 4237 arranged in sequence in the forwarding direction of the playing cards. Through the cooperative operation between the first sensor 4235 and the third sensor 4237, the length and distance simultaneously covered by the playing cards in the delivery passage are detected to determine whether there are multiple playing cards overlapping each other. If the first sensor 4235 and the third sensor 4237 are blocked simultaneously (the playing cards are detected), it is determined that there are two partially overlapping playing cards entering the delivery passage, and the card dealing motor 4220 reverses and returns the playing cards to the card storage box 41 to feed and distribute the cards again.

In the situation where the playing cards are delivered forward along the width edge in the card dealing device (that is, the width of the delivery passage is similar to the width of the playing cards), the distance between the first sensor 4235 and the third sensor 4237 is 2 mm to 3 mm greater than the length of the playing card.

In the situation where the playing cards are delivered forward along the length edge in the card dealing device (that is, the width of the delivery passage is similar to the length of the playing cards), the distance between the first sensor 4235 and the third sensor 4237 is 2 mm to 3 mm greater than the width of the playing card.

The second sensor 4236 is set between the first sensor 4235 and the third sensor 4237. When the second sensor 4236 is blocked (a playing card is detected), the card turning motor 4230 is activated as needed to flop the card over. The second sensor 4236 can further operate cooperatively with the first sensor 4235 and the third sensor 4237 to assist in determining whether there are partially overlapping playing cards. In this embodiment, the first sensor 4235, the second sensor 4236, and the third sensor 4237 are all photoelectric sensing modules.

In this way, the single pieces of playing cards separated by the card distribution mechanism, after passing through the first sensor, the camera captures images for front and rear side identification. When the playing card continues to move forward along the passage to arrive at the position of the second sensor, the card turning mechanism is controlled to flip or not to flip the card according to the identification result. If the first sensor is blocked first, until the third sensor is also blocked simultaneously (that is, playing cards continue to be detected), it means that two playing cards are partially overlapped and enter the delivery passage. The card dealing motor turns on reversing function and returns the playing cards entering the delivery passage back to the card storage box to separate the cards into single pieces again, thereby ensuring the accuracy of the number of cards that are dealt.

The image identification method is used to identify the front and rear sides of a playing card. Due to the uncertainty of the pattern on the rear side of the playing card, identification errors are likely to occur. Therefore, it is preferable to use the learning mode to identify the front and rear sides of the playing cards. In this way, identification learning can be performed on the playing cards that are put into the playing card machine by setting the learning mode, so as to improve the efficiency and accuracy of playing card identification.

The learning mode may be automatic coding or convolutional neural network. The neural network does not require a mathematical model. In fact, neural network only requires a feature pattern for comparison. If the comparison result is a match, the comparison between other positions and the entire image is activated. Such model requires a lot of memory and a powerful CPU. Therefore, it is preferable to adopt the learning mode of deep automatic encoding, which is to first develop a mathematical model (encoder), the input pattern is sampled in multiple layers, abstract feature information is extracted, and the encoder is used to generate feature codes, and a certain number of samples is adopted to perform correction on the feature codes.

In this embodiment, the method of identifying the front side and rear side of the playing cards through learning mode is performed by sampling the pattern on the rear side or character pattern on the front side of multiple playing cards to generate a feature code, the feature code is saved, and then this feature code is used to match the pattern in comparison, thus identifying the front side and rear side of the playing cards.

The preferred implementation is that the playing card machine is configured with a learning mode and a card playing mode. In the learning mode, multiple playing cards are placed in the machine either with front side down or rear side down in consistency (for example, a set of new playing cards that are placed either with front side down or rear side down in consistency). The playing card machine samples the pattern on the rear side or character pattern on the front side of the multiple playing cards to generate a feature code, and the feature code is saved. In the card playing mode, the playing card machine obtains the pattern on the rear side or character pattern on the front side of the multiple playing cards to match the feature code with the pattern in comparison, so as to identify the front and rear side of the playing card. According to the identification result, the card turning mechanism is controlled to flip or not to flip the playing card.

Figure 11:
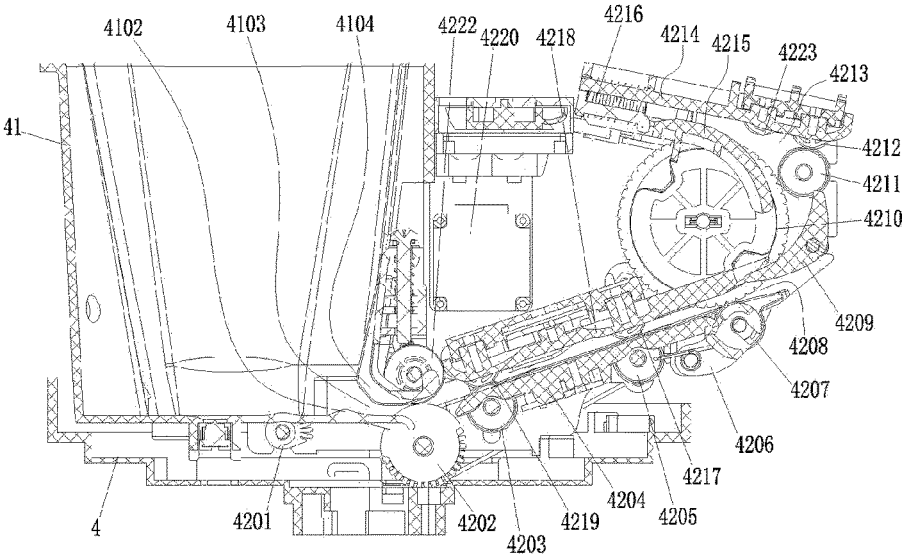
FIG. 11 is a second cross-sectional view of the card dealer in the first embodiment of the disclosure (the state of dealing cards directly).
Figure 12:
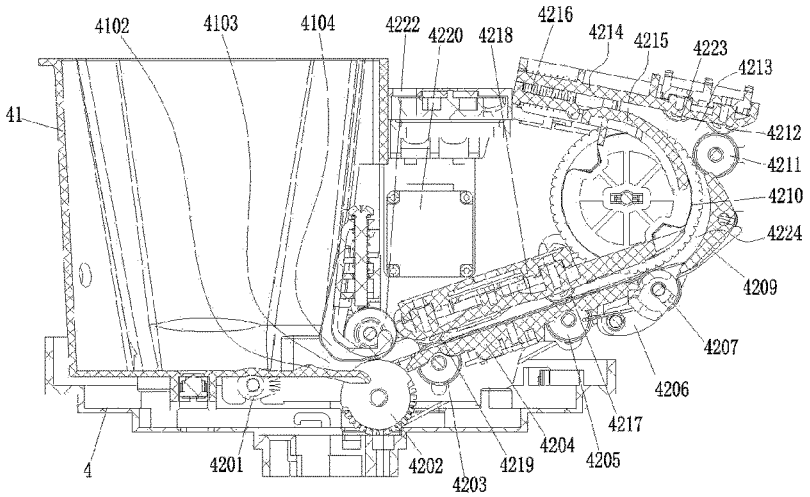
FIG. 12 is a third cross-sectional view of the card dealer in the first embodiment of the disclosure (the state of dealing cards after flipping the cards).
Figure 15:
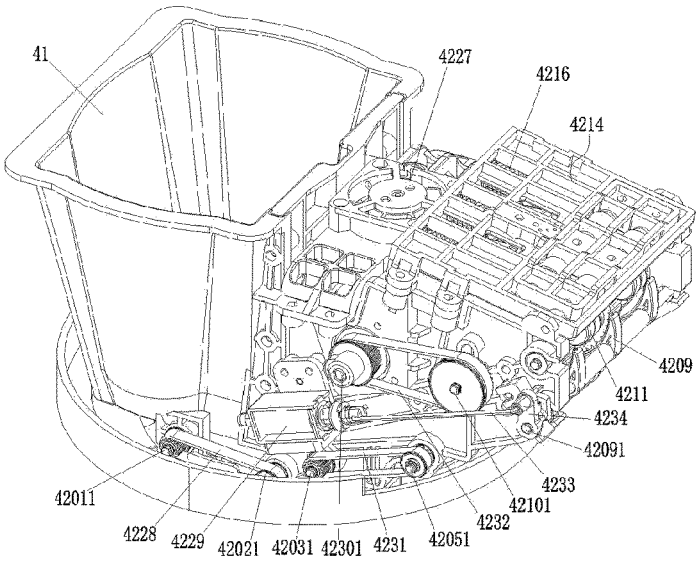
FIG. 15 is a second perspective view of the card dealer in the first embodiment of the disclosure.

As shown in FIG. 9 to FIG. 12, the card turning mechanism includes the first card discharge pressing wheel 4207, the card turning wheel 4210, the card turning pressing wheel 4211, and the second card discharge pressing wheel 4212. The card turning wheel 4210 is the driving wheel and is driven by the card turning motor 4230 to rotate (as shown in FIG. 15, the card turning motor shaft 42301 and the card turning axle 42101 are in transmission connection through the card turning transmission belt 4232). The first card discharge pressing wheel 4207, the card turning pressing wheel 4211 and the second card discharge pressing wheel 4212 are all driven wheels. The first card discharge pressing wheel 4207 and the card turning pressing wheel 4211 are in rolling contact with the card turning wheel 4210. The second card discharge pressing wheel 4212 is in rolling contact with the card turning pressing wheel 4211. The first card discharging passage 4208 is formed between the card turning wheel 4210 and the first card discharge pressing wheel 4207. The card turning passage 4224 is formed between card turning wheel 4210 and card turning pressing wheel 4211. The second card discharging passage 4213 is formed between the card turning pressing wheel 4211 and the second card discharge pressing wheel 4212. The card turning wheel 4210 is installed inside the card turning passage 4224 and is located between the first card discharging passage 4208 and the second card discharging passage 4213. The card turning passage 4224 extends along part of the arc-shaped circumference from one side of the card turning wheel 4210 close to the first card discharging passage 4208 to the other side of the card turning wheel 4210 away from the first card discharging passage 4208. The card turning component 4209 configured to open or close the card turning passage 4224 or the first card discharging passage 4208 is disposed at one end at the outer side of the card turning passage 4224 close to the first card discharging passage 4208. The card pushing member 4216 is provided at one end of the card turning passage 4224 away from the first card discharging passage 4208. The second card discharging passage 4213 is provided on the outer side of the card turning passage 4224 at a position opposite to the card pushing member 4216. The card turning component 4209 is driven by the card turning drive mechanism to swing, so as to open or close the card turning passage 4224 or the first card discharging passage 4208. As shown in FIG. 11, when the card turning component 4209 closes the outlet of the card turning passage 4224 or opens the outlet of the first card discharging passage 4208, the card feeding passage 4103, the delivery passage and the first card discharging passage 4208 are connected in sequence. The playing cards are sent from the first card discharging passage 4208 to the card reception position of the card receptor 2. As shown in FIG. 12, when the card turning component 4209 opens the outlet of the card turning passage 4224 and closes the outlet of first card discharging passage 4208, the card feeding passage 4103, the delivery passage, the first card discharging passage 4208, the card turning passage 4224 and the second card discharging passage 4213 are connected in sequence. After the playing cards are discharged from the first card discharging passage 4208, they are blocked by the card turning component 4209 and turned to enter the card turning passage 4224, and are sent to the terminal end of the card turning passage 4224 by the card turning wheel 4210 and the card turning pressing wheel 4211. The front end of the playing card abuts against the card pushing member 4216. The rear end of the playing card is restored to the flat state after being pressed by the card turning pressing wheel 4211. Under the force of the card pushing member 4216, the rear end of the playing card first enters the second card discharging passage 4213 is sent to the card reception position of the card receptor 2 by the card turning pressing wheel 4211 and the second card discharge pressing wheel 4212. In this way, the card turning passage reverses the playing cards that pass through by flipping the cards by 180° to reverse the front side and rear side of the playing cards.

It should be noted that in other embodiments of the disclosure, the first card discharging passage 4208 and the second card discharging passage 4213 may not be directly connected to the outlet of the card reception position of the card receptor 2. That is, one or more passages (or delivery wheels/delivery rollers) for continuing to deliver the playing cards may be further provided following the first card discharging passage 4208 and/or the second card discharging passage 4213, then the playing cards are sent to the card reception position of the card receptor 2.

These parts, including the card turning wheel 4210, the first card discharge pressing wheel 4207, the card turning pressing wheel 4211 and the second card discharge pressing wheel 4212, each may be a roller part or composed by multiple wheel-shaped parts arranged on the same shaft. In this embodiment, the card turning wheel 4210, the first card discharge pressing wheel 4207, the card turning pressing wheel 4211 and the second card discharge pressing wheel 4212 all include multiple wheels installed on their respective shafts, and the card turning component 4209 also includes multiple parts arranged on the rotating shaft. The card turning component 4209 and the card turning wheel 4210 are arranged in a staggered manner. In this design, the structure is simple and the installation and cooperative operation are convenient. A rubber ring can be arranged on the card turning wheel 4210, the first card discharge pressing wheel 4207, the card turning pressing wheel 4211 and/or the second card discharge pressing wheel 4212 to increase the friction between them and the playing cards.

Figure 24:
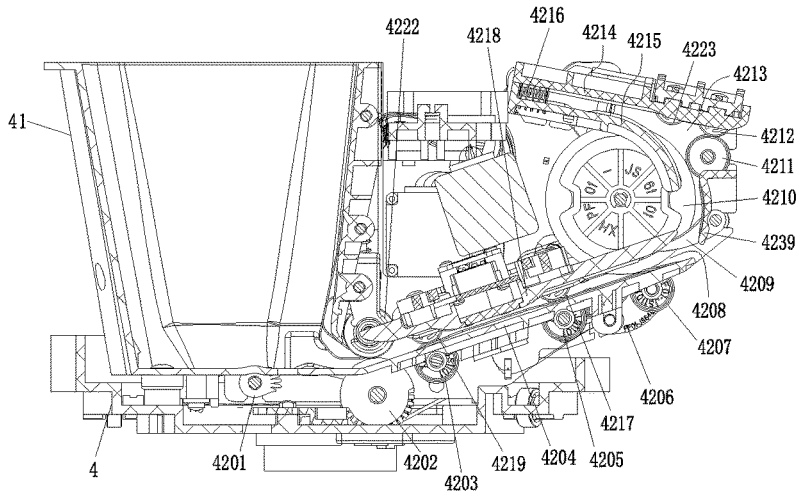
FIG. 24 is a first cross-sectional view of another implementation of the card dealer in the first embodiment of the disclosure (the state of dealing cards directly).
Figure 25:
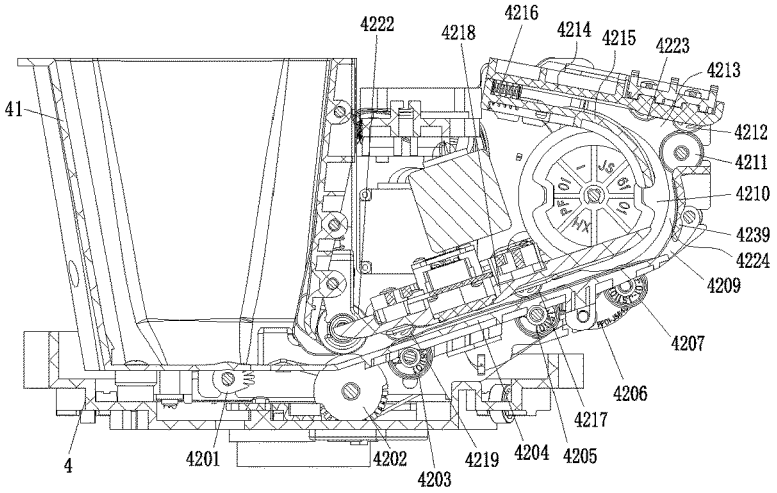
FIG. 25 is a second cross-sectional view of another implementation of the card dealer in the first embodiment of the disclosure (the state of dealing cards after flipping cards).
Figure 26:
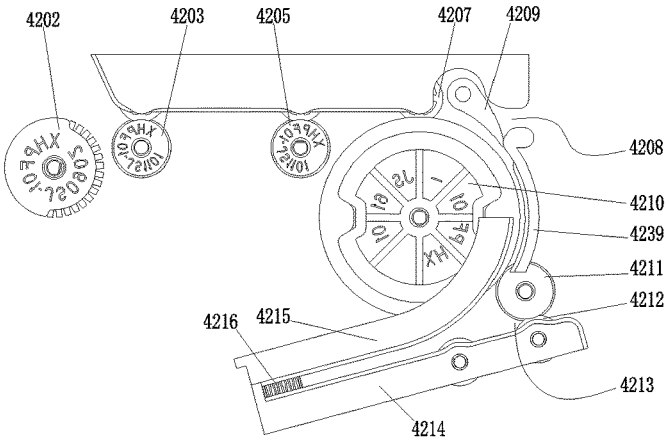
FIG. 26 is a schematic view of still another implementation of the card dealer in the first embodiment of the disclosure (the state of dealing cards after flipping cards).

In this embodiment, as shown in FIG. 11 to FIG. 14, the card turning passage 4224 includes an inner side wall 4215 of the card turning passage, and the swing center (card turning reel 42091) of the card turning component 4209 is located in the middle position, so that two swinging ends are formed on both sides of the swing center. The inner side of the card turning component 4209 is an arc shape corresponding to the outer circumference of the card turning wheel 4210, so that the card turning component 4209 not only can better serve the blocking and flipping functions, but also the card turning component 4209 can serve as the outer side wall of the card turning passage, and there is no need to additionally set the outer side wall of the card turning passage. In other embodiments, as shown in FIG. 24, FIG. 25, and FIG. 26, the swing center (card turning reel 42091) of the card turning component 4209 is located at one end of the card turning component 4209, and the card turning passage outer wall 4239 needs to be additionally set up to ensure that the playing cards pass smoothly in the card turning passage 4224.

In this embodiment, the card turning passage 4224 and the second card discharging passage 4213 are arranged above the first card discharging passage 4208 (that is, the card turning wheel 4210, the card turning pressing wheel 4211, and the second card discharge pressing wheel 4212 are located above the first card discharge pressing wheel 4207). In this way, the height setting of the card dealer and even the playing card machine is more reasonable, the model is thinner and the number of cards stored is more. Of course, if space permits, the card turning passage 4224 and the second card discharging passage 4213 can also be placed under the first card discharging passage 4208 (that is, the card turning wheel 4210, the card turning pressing wheel 4211 and the second card discharge pressing wheel 4212 are located below the first card discharge pressing wheel 4207), as shown in FIG. 26.

In order to prevent playing cards from sticking to the side wall in the card turning passage 4224, and to make sure that the playing cards can enter the second card discharging passage 4213 between the card turning pressing wheel 4211 and the second card discharge pressing wheel 4212, a transition wheel 4223 is arranged on one side of the second card discharge pressing wheel frame 4214 provided with the second card discharge pressing wheel 4212 close to the card turning wheel 4210 to guide the playing cards to a position between the card turning pressing wheel 4211 and the second card discharge pressing wheel 4212.

In order to ensure the delivery pressure and avoid slipping, it is preferable to give the first card discharge pressing wheel 4207 and/or the card turning pressing wheel 4211 the tendency of pressing the card turning wheel 4210 through the respective energizing mechanism. Preferably, the tendency of pressing the card turning pressing wheel 4211 is provided to the second card discharge pressing wheel 4212 through the energizing mechanism. These energizing mechanisms can be elastic components such as springs, elastic sheets, elastic rings, or elastic shafts, or they can be elastic energizing mechanisms composed of multiple components. In this embodiment, the first card discharge pressing wheel 4207 is rotatably installed on the first card discharge pressing wheel frame 4206. The first card discharge pressing wheel frame 4206 is hinged with the delivery bottom wall 4204 of the delivery passage, and a torsion spring is sleeved on the hinge shaft to facilitate the first card discharge pressing wheel 4207 to press the card turning wheel 4210 tightly. The card turning pressing wheel 4211 is provided with an elastic rubber ring to press against the card turning wheel 4210. The second card discharge pressing wheel 4212 is provided on the second card discharge pressing wheel frame 4214 through an elastic shaft, so as to press the card turning pressing wheel 4211 tightly. In this way, the installation is convenient, and the structure is simple and reliable.

The card turning drive mechanism that drives the card turning component 4209 to open or close the first card discharging passage 4208 (open the card turning passage 4224) can be realized by motor with a deceleration mechanism or a transmission mechanism. In this embodiment, as shown in FIG. 15, the electromagnet 4229 is used for driving. One end of the card turning shaft 42091 of the card turning component 4209 is fixed to the crank 4234. The swing end of crank 4234 is connected to the movable end of the electromagnet 4229 through the connection rod 4233. In this way, when the card turning component 4209 is required to operate, the electromagnet 4229 pulls the card turning component 4209 to swing through the connection rod 4233 and the crank 4234. Because the card turning action is performed based on the result of the camera identifying the front and rear sides of the playing card, which is selective and intermittent, the electromagnet structure of this embodiment is more reasonable and the manufacturing cost is low.

The card pushing member 4216 can be an elastic member such as a spring, an elastic piece, an elastic band, etc., or an elastic energizing mechanism composed of multiple components. In this embodiment, the card pushing member 4216 is a plurality of springs arranged at the terminal end of the passage. Such structure is simple and easy to configure.

In another alternative implementation of the card turning mechanism, the card turning passage 4224 is directly connected to the card storage box 41, and the second card discharging passage 4213, the second card discharge pressing wheel 4212 and the card pushing member 4216 are no longer provided. The playing cards that are flipped over are directly returned to the card storage box for the cards to be fed and dealt again. That is, the card turning mechanism includes the first card pressing wheel, the card turning wheel and the card turning pressing wheel. The card turning wheel is the driving wheel and is driven by the card turning motor to rotate. The first card discharge pressing wheel and the card turning pressing wheel are all driven wheels. The first card discharge pressing wheel and the card turning pressing wheel are in rolling contact with the card turning wheel respectively. The first card discharging passage is formed between the card turning wheel and the first card discharge pressing wheel. The card turning passage is formed between the card turning wheel and the card turning pressing wheel. The card turning wheel is installed inside the card turning passage. The card turning passage extends along the partial arc-shaped circumference of the card turning wheel from one side of the card turning wheel close to the first card discharging passage to the other side of the card turning wheel away from the first card discharging passage. The terminal end of the card turning passage is connected to the space inside the card storage box, and the card turning component used to open or close the card turning passage or the first card discharging passage is set at one end at the outside of the card turning passage close to the first card discharging passage. The card turning drive mechanism drives the card turning component to swing so as to open or close the card turning passage or the first card discharging passage. When the card turning component closes the outlet of the card turning passage or opens the outlet of the first card discharging passage, the card feeding passage, the delivery passage and the first card discharging passage are connected in sequence, and the playing cards are sent from the first card discharging passage to the card reception position of the card receptor. When the card turning component opens the outlet of the card turning passage and closes the outlet of the first card discharging passage, the card feeding passage, the delivery passage, the first card discharging passage, and the card turning passage are connected in sequence. The playing cards are blocked by the card turning component after coming out from the first card discharging passage and turned to enter the card turning passage, and are sent to the terminal end of the card turning passage by the card turning wheel and the card turning pressing wheel to enter the card storage box (a plurality of delivery wheels and pressing wheels thereof can be provided between the card storage box and the card turning wheel to deliver playing cards). In this way, the card turning passage reverses the playing cards that pass through to realize the flipping of the front and rear sides of the playing cards. The rest of the structure is the same as above. This structural scheme can design the depth of the card storage box to be shallow and the height of the playing card machine to be low, but the card dealing efficiency is relatively low and the manufacturing cost is high.

The playing card machine as described above includes a card receptor 2 and a card dealer. The card dealer is installed in the center of the card receptor 2 and is driven to rotate relative to the card receptor 2 by a rotation drive mechanism. A plurality of card reception positions are arranged on the card receptor 2 around the card dealer. The card dealer includes the card storage box 41 and the card dealing device 42. The card storage box 41 and card dealing device 42 are located on the left and right sides of the dealer seat 4, respectively. One side at the bottom portion of the card storage box 41 is connected to the card feeding passage of the card dealing device 42. The card dealing device 42 includes the card distribution mechanism configured to separate a pile of playing cards that are organized in the card storage box into single pieces and distribute them to the delivery mechanism. The delivery mechanism configured to identify the front and rear sides of the playing cards and deliver the playing cards to the card turning mechanism, and the card turning mechanism configured to flip the playing cards as needed and send the playing cards to each card reception position on the card receptor 2.

The playing cards sorting method for the playing card machine described above includes the following steps.

1) Placing the playing cards sorted into a pile into the card storage box.

2) The card distribution mechanism separates a pile of playing cards that are organized in the card storage box into single pieces and distribute them to the delivery mechanism.

3) The delivery mechanism identifies the front and rear sides of the playing cards and delivers the playing cards to the card turning mechanism.

4) The card turning mechanism flips the playing cards as needed and sends the playing cards to each card reception position on the card receptor.

Second Embodiment

A playing card machine as shown in FIG. 27 to FIG. 40 is a simplified version of the first embodiment. The difference between the two is described in the following.

The playing card machine in this embodiment does not have the function of identifying and flipping cards. Therefore, the identification component for identifying the front and rear sides of playing cards and the card turning mechanism are omitted from the card dealing device.

The rest of structure is basically the same as that of the first embodiment, and the specific description is as follows.

A playing card machine as shown in FIG. 27 to FIG. 30 includes a base 1 and a machine core. The machine core is arranged on the base or inside the base, and the machine core includes a card receptor 2 and a card dealer. The machine core can be driven to move up or down on the base 1 by a lifting drive mechanism. The card dealer is arranged at the center of the card receptor 2 and can be driven by a rotation drive mechanism to rotate relative to the card receptor 2. The card dealer includes a card storage box 41, a card distribution mechanism and a delivery mechanism. Multiple card reception positions are provided around the card dealer on the card receptor 2. A panel 3 is provided on the top portion of the card receptor 2. A card placing hole is provided on the panel 3. A door plate 31 and a drive mechanism thereof are configured on the card placing hole, and the card storage box 41 is provided under the card placing hole.

Figure 27:
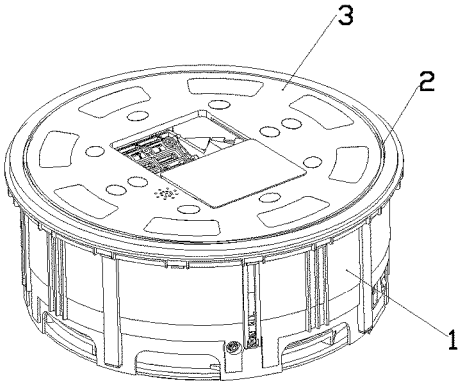
FIG. 27 is a perspective view of the playing card machine in the second embodiment of the disclosure (the machine core is not raised).
Figure 28:
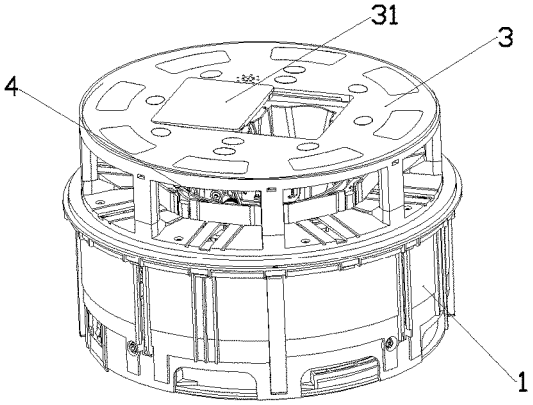
FIG. 28 is a perspective view of the playing card machine in the second embodiment of the disclosure (the machine core is raised).

As shown in FIG. 27 and FIG. 28, in this embodiment, the base 1 includes a circular bottom plate and a barrel-shaped side wall. A power supply and a power switch thereof are installed on the base, and a lifting drive mechanism for driving the machine core to move up and down is disposed on the base. The distributed playing cards are placed on the card receptor 2 of the machine core.

The playing card machine can be placed on the desktop as an independent machine for players to use. In this scenario, the playing card machine may not have a lifting drive mechanism (the base and the card receptor are integrated as a whole), but multiple openings are provided on the side wall of the base for the players to take the playing cards. Most of the time, this playing card machine is embedded in the center hole of the game table, only the panel 3 is exposed and aligned with the desktop, so that the panel will not interfere with the player's playing cards. Meanwhile, the playing card machine can be easily manufactured, configured, and maintained. In this scenario, a lifting drive mechanism needs to be provided on the base to drive the distributed playing cards of all parties to rise so that the players can take the playing cards. It should be noted that the base and the card receptor of the disclosure are not limited to a cylindrical shape, and can also be square column, polygonal column, quincunx, frustum, and other shapes.

In this embodiment, the panel 3 is provided with buttons for controlling actions such as turning on machine and dealing cards, etc. During the card game, the player can set game rules on the control panel. The playing card machine distributes cards to each player according to the set game rules. When the cards are distributed, the rotation drive mechanism drives the card dealer to rotate and randomly distribute the cards to each player. The cards are intermittently distributed to the card reception position of each player on the card receptor according to the number of cards set by the player. The door plate 31 and its drive mechanism are installed on the panel 3. Reference to the door plate 31 and its drive mechanism can be derived from various structures disclosed in a series of patent documents such as CN103157272 and CN108525278.

In this embodiment, the panel 3 is fixed at the top portion of the card receptor 2. The card receptor 2 and the base 1 are not fixed and can be moved up and down. By arranging multiple guide columns and guide sleeves or slots and sliding blocks that operate cooperatively around the card receptor and the base, up-down guidance can be realized. A plurality of guide rollers 204, which are provided around the card receptor 2, operate cooperatively with the guide groove on the side wall of the base 1 to realize up-down guidance of the card receptor 2. The panel 3 is fixed at the top portion of the card receptor 2. There are multiple openings on the side walls around the card receptor 2. When the card receptor 2 drops to the bottom, the panel 3 is aligned with the desktop of the game table. When the card receptor 2 is completely lifted, the bottom wall of the multiple openings on the side walls around the card receptor 2 is aligned with the desktop of the game table. There are multiple card reception positions 200 provided around the card receptor 2, the card reception positions correspond to the openings, and each card reception position is provided with a card pushing plate 202 and a card pushing slot 21. The card pushing plate 202 is driven by a card pushing mechanism to perform a reciprocating movement from the inside to the outside of the card reception position. When the card dealer deals cards, the card pushing plate 202 moves to the inner side of the card reception position close to the card dealer, and the playing cards are sent to the card reception position. When the machine core is raised to the desktop, the card pushing plate 202 moves along the card pushing slot 21 outward from the inner side, and pushes the playing cards at the card reception positions out of the machine core to the desktop. The card pushing slot 21 extends to the outer side from the inner side of the card reception position. The card pushing slot 21 is preferably arranged radially along the circumference of the card receptor.

Figure 35:
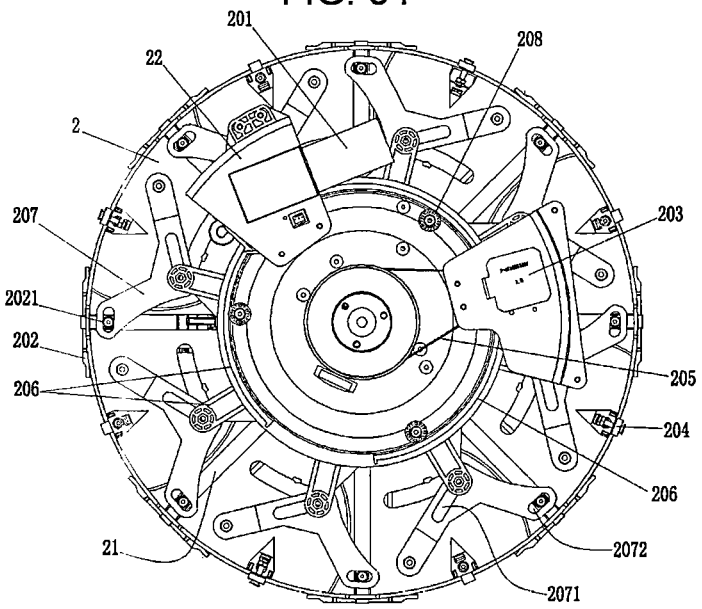
FIG. 35 is a bottom view of the bottom portion of the card receptor in the second embodiment of the disclosure (the card pushing plate has performed the pushing action).
Figure 36:
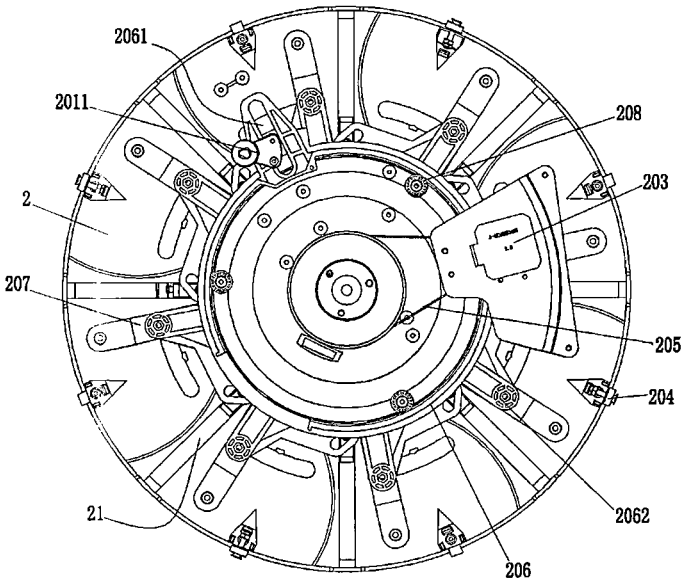
FIG. 36 is a bottom view of the bottom portion of the card receptor in the second embodiment of the disclosure (the card pushing plate has not performed the pushing action).
Figure 37:
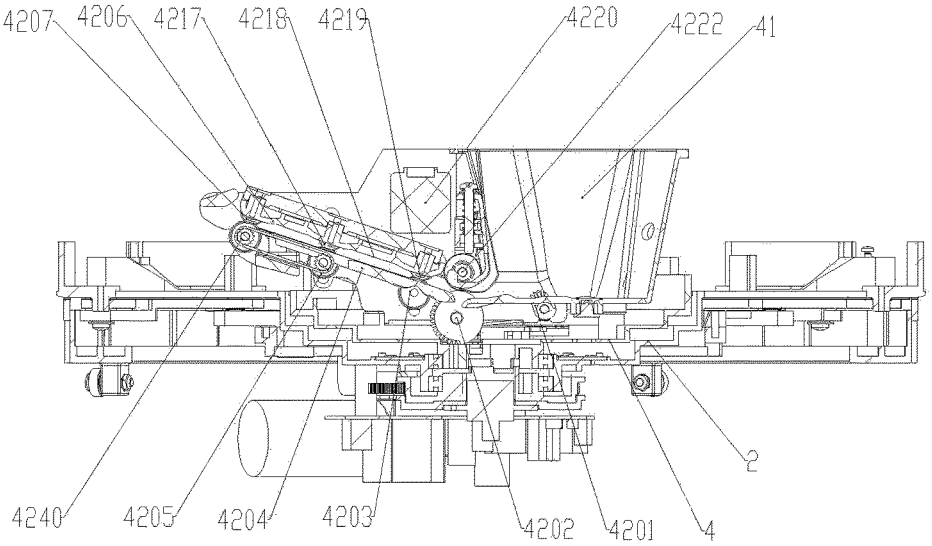
FIG. 37 is a cross-sectional view of the machine core of the playing card machine in the second embodiment of the disclosure.

As shown in FIG. 35 and FIG. 36, the card pushing drive mechanism is arranged under the card receptor 2, and includes a card pushing motor 201, a card pushing drive member 206, and a plurality of card pushing swing arms 207 corresponding to the plurality of card pushing plates 202 one-to-one. The card pushing drive member 206 has a circular ring shape. The card pushing drive member 206 is installed at the bottom portion of the card receptor 2 through a plurality of positioning rollers B208 and is driven to rotate by the card pushing motor 201. There are multiple drive parts corresponding to the multiple card pushing swing arms 207 one-to-one and extending from the outer circumference of the card pushing drive member 206. One drive part is movably connected to the middle of one card pushing swing arm 207 through the slot A2071. One end of the card pushing swing arm 207 is movably connected (hinged) to the bottom portion of the card receptor 2. The other end of the card pushing swing arm 207 is movably connected to the bottom portion of the card pushing plate 202 through the slot B2072 and the card pushing roller 2021. In this way, the card pushing drive member 206 is rotated to push various card pushing swing arms 207 to rotate, thereby pushing the card pushing plate 202 to perform card pushing action from the inner side of the card reception position toward the outer side or perform reciprocating action from the outer side of the card reception position toward the inner side. Such card pushing drive member simultaneously drives the multiple card pushing plates, has a simple structure, performs reasonable actions, operates reliably, and has a low manufacturing cost. The card pushing swing arm 207 is in the shape of a V-shaped boomerang. The card pushing motor 201 drives the card pushing drive member 206 to rotate through the engagement structure of gear and gear ring, or the card pushing motor 201 drives the card pushing drive member 206 to rotate through the engagement structure of the card pushing cam 2011 and the slot 2061.

Figure 29:
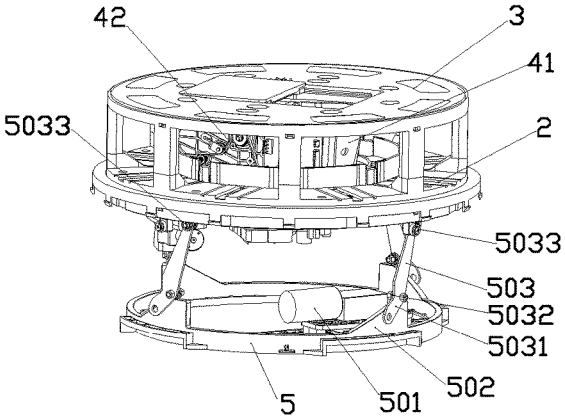
FIG. 29 is a perspective view of the playing card machine in the second embodiment of the disclosure (the machine core is raised, the base is omitted).
Figure 30:
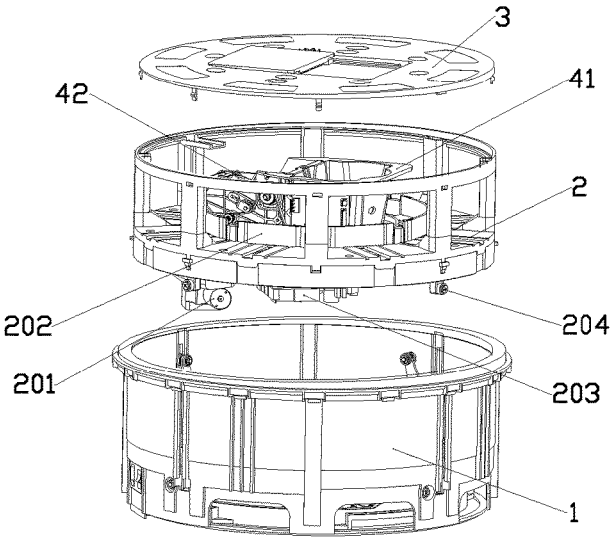
FIG. 30 is an exploded view of the playing card machine in the second embodiment of the disclosure.
Figure 32:
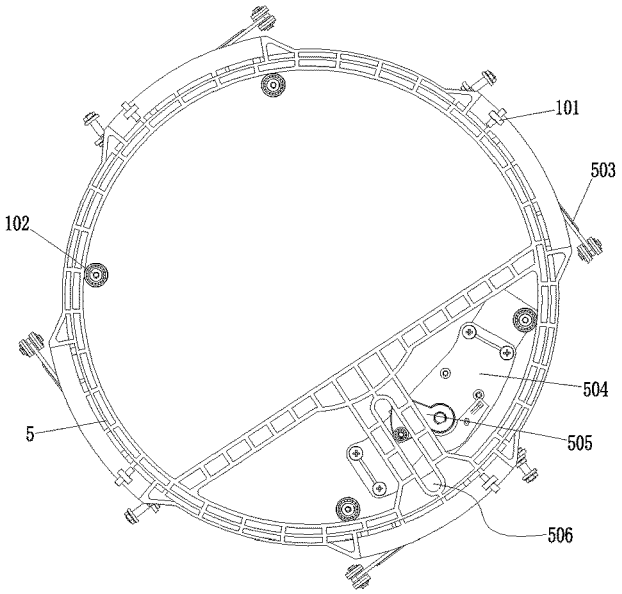
FIG. 32 is a schematic view of the structure of the machine core lifting mechanism in the second embodiment of the disclosure.
Figure 33:
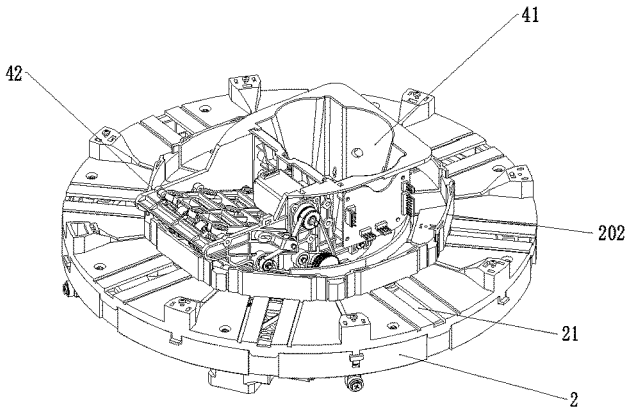
FIG. 33 is a perspective view of the machine core of the playing card machine in the second embodiment of the disclosure (the card pushing plate has not performed pushing action).
Figure 34:
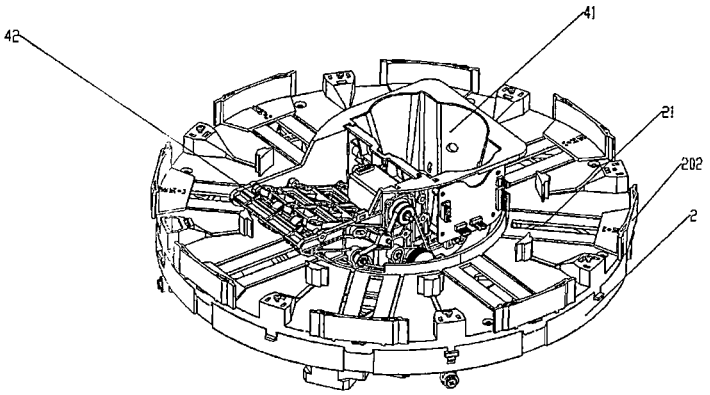
FIG. 34 is a perspective view of the machine core of the playing card machine in the second embodiment of the disclosure (the card pushing plate has performed pushing action).

As shown in FIG. 29 and FIG. 32, the machine core lifting drive mechanism includes a lifting drive member 5, a lifting motor 501, and a plurality of lifting swing arms 503. The multiple lifting swing arms 503 are evenly distributed under the card receptor 2 of the machine core. One end of the lifting swing arm 503 is hinged with the base 1, and the other end 5033 of the lifting swing arm 503 abuts against the bottom portion of the card receptor 2 of the machine core. The lifting swing arm 503 is driven by the lifting motor 501 through the lifting drive member 5 to simultaneously swing up and down to move the machine core up and down. In this embodiment, the lifting drive member 5 has a circular ring shape, and the top portion of the circumference of the ring is provided with a plurality of lifting protrusions 502 corresponding to the plurality of lifting swing arms 503. The lifting protrusions 502 abut against the middle support rollers 5032 of the lifting swing arms 503. The lifting drive member 5 is installed on the base 1 through the support roller 101 and the positioning roller 102 and can rotate around the center of rotation. In this embodiment, a plurality of support rollers 101 are arranged outside the circular ring of the lifting drive member. A recess which operates cooperatively with the support roller is provided on the lifting drive member, so as to limit the rotation range of the lifting drive member 5. A plurality of positioning rollers 102 are installed on the inner side of the circular ring of the lifting drive member 5, so as to position the rotation center of the lifting drive member. When the lifting drive member 5 rotates under the driving of the lifting motor 501, the middle support rollers 5032 on the plurality of lifting swing arms 503 respectively move along the corresponding lifting protrusions 502 on the lifting drive member 5, so that the lifting protrusions 502 push the lifting swing arms 503 to swing, so that one end 5033 of the lifting swing arm 503 abutting against the bottom portion of the machine core moves up and down, that is, the effect of moving the machine core up and down can be realized. In this embodiment, the lifting motor 501 is installed on the base 1 through the lifting motor bracket 504. The output shaft (or the output shaft of the decelerating mechanism connected to the lifting motor) of the lifting motor 501 is provided with the lifting cam 505 that rotates horizontally. On the lifting cam 505, through the rolling operation between the roller and the lifting slid slot 506 on the lifting drive member 5, the lifting drive member 5 is driven to rotate. In other embodiments, the lifting motor can further drive the lifting drive member to rotate through a driving gear and a gear ring which are engaged internally or externally.

Figure 31:
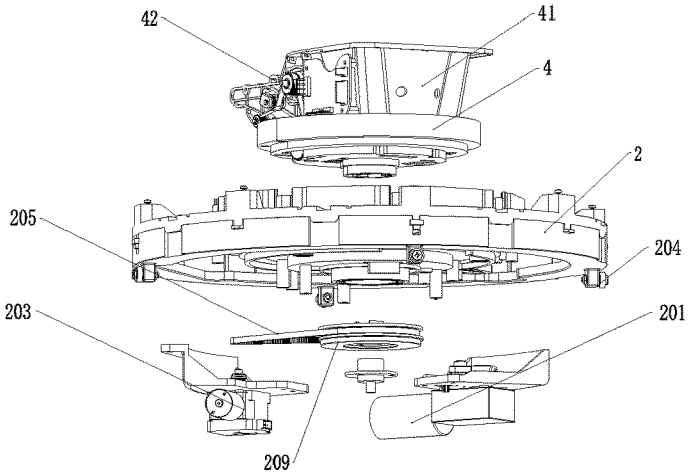
FIG. 31 is an exploded view of the machine core of the playing card machine in the second embodiment of the disclosure.

As shown in FIG. 30, FIG. 31, FIG. 33, and FIG. 34, the card dealer is fixed on the dealer seat 4. The dealer seat 4 is installed in the center of the upper part of the card receptor 2 through a bearing rotation, and is driven to rotate by a rotation drive mechanism. As shown in FIG. 31, the rotation drive mechanism includes a rotating motor 203 installed at the bottom portion of the card receptor 2 and a driven wheel 209 that rotates synchronously with the dealer seat 4 in a fixed circumferential direction. The rotating motor 203 drives the driven wheel 209 through the rotating transmission belt 205 and thus driving the dealer seat 4 to rotate.

The passage for playing cards to pass therethrough in the card dealer includes the card feeding passage, the delivery passage, and the first card discharging passage that are connected in sequence.

The card distribution mechanism is installed at the card feeding passage of the card dealer, and the delivery mechanism is installed at the delivery passage.

As shown in FIG. 37 to FIG. 40, the card dealer includes a card storage box 41, a card distribution mechanism and a delivery mechanism. The card storage box 41 is located on one side of the dealer seat 4, and the card distribution mechanism and the delivery mechanism are located on the other side of the dealer seat 4. One side of the bottom portion of the card storage box 41 is in communication with the card feeding passage of the card dealing device 42. In the embodiment, the card storage box is configured to place a pile of playing cards that are organized. The bottom portion of the card storage box 41 is provided with a detection sensor for detecting whether the playing cards are placed therein and the card sending wheel 4201 configured to push the playing cards to the card feeding passage of the card dealing device. A card stopper plate is formed on a side wall of the card storage box 41 close to the card feeding passage of the card dealing device. Multiple card feeding ribs are provided on the card stopper plate. The card distribution wheel 4202 of the card dealing device is provided under the card feeding ribs. Multiple card feeding protrusions are formed on an inner wall at the bottom portion of the card storage box 41 between the card sending wheel 4201 and the card distribution wheel 4202. In this way, these card feeding protrusions and the card feeding ribs form the card feeding passage of the card dealing device. Such card feeding passage with protruding and recessed structures helps to separate the multiple overlapping playing cards through squeezing and rubbing. Further preferably, a plurality of card feeding protrusions and a plurality of card feeding ribs are alternately arranged in a staggered manner to achieve a better card rubbing and separating effect.

The card distribution mechanism can adopt various card distribution structures disclosed in a series of patent publication of CN108525278A and CN105854274A, etc. However, although these card distribution structures can better separate the fed playing cards to ensure single pieces of them to pass therethrough, it is difficult to make the playing cards that have been fed into the delivery passage to be withdrawn (card withdrawal) from the card feeding passage. Once the above situation occurs, when the sensor subsequently detects that two playing cards are overlapped and it is necessary to withdraw the overlapped playing cards from the notification of card sending for further card separation, the difficulty of card withdrawal will occur. In order to overcome this technical problem, in this embodiment, the card separating mechanism includes a card stopper plate, a card sending wheel 4201, a card distribution wheel 4202, and a card distribution press wheel 4222. The card sending wheel 4201 configured for pushing the playing cards to the card feeding passage of the card dealing device is disposed at the bottom portion of the card storage box 41. The card distribution press wheel 4222 is disposed at the bottom portion of the card stopper plate 4105. The card distribution wheel 4202 is disposed under the card distribution press wheel 4222. The card distribution wheel 4202 is driven by the card dealing motor to rotate. The card distribution press wheel 4222 performs non-rotation when cards are fed in and performs rotation when cards are discharged by one-way clutching mechanism. In this way, not only that the cards can be quickly and effectively distributed when the cards are fed in, when the cards need to be withdrawn, the card distribution press wheel 4222 can operate cooperatively with the card distribution wheel 4202 to rotate reversely, thereby realizing card withdrawal quickly and reliably, thus preventing card withdrawing problem. Further preferably, the card distribution press wheel 4222 and the card distribution wheel 4202 are designed to be misaligned in the front-rear direction and overlapped in the up-down direction (that is, the axes of the card distribution press wheel 4222 and the card distribution wheel 4202 are staggered by a horizontal distance, and axis of the card distribution press wheel 4222 is closer to the card storing space of the card storage box 41 than the axis of the card distribution wheel 4202, the bottommost point of the card distribution press wheel 4222 is lower than the highest point of the card distribution wheel 4202). In this way, when multiple playing cards enter the gap between the card distribution press wheel and the card distribution wheel, the feeding end of the playing cards will be cocked, so that the two overlapped playing cards are misaligned, thus preventing them from being adhered together electrostatically and cannot be separated. Since the card distribution press wheel is controlled by the one-way clutching mechanism and cannot be rotated, the static friction between the card distribution press wheel and the playing card on the top is much greater than the friction between the two overlapped playing cards. Moreover, the delivery force of the playing cards is applied by the card distribution wheel and applied to the playing card underneath. Therefore, the playing card underneath is delivered to move forward continuously, and the playing card at the top is retained temporarily. The two overlapped playing cards are separated quickly, the structure is simple, maintenance is easy, and accuracy is high.

In order to further enhance the card distribution effect of the card distribution mechanism, the bottom portion of the card stopper plate is provided with a number of card feeding ribs, and a number of card feeding protrusions are formed on the inner wall of the bottom portion of the card storage box between the card sending wheel and the card distribution wheel. The card feeding rib is closer to the card distribution press wheel than the card feeding protrusion, so that the card feeding passage of the card dealing device is formed between the card feeding protrusion, the card feeding rib and the card distribution wheel. The card feeding passage has protruding structures at the two ends (card feeding protrusion and card distribution wheel) and recessed structure at the middle part. In this way, the card feeding passage with protruding and recessed structures helps to separate the multiple overlapped playing cards by squeezing and rubbing, thereby ensuring that the multiple playing cards entering the position of card distribution wheel and card distribution press wheel are separated and staggered. In addition, because the card feeding protrusion will lift the playing cards in the card storage box out of the card feeding passage, when the cards are withdrawn, the playing cards withdrawn from the card feeding passage will be inserted under the playing cards in the card storage box 41, so as to avoid the difficulty of pushing cards due to two playing cards abutting against each other. Further preferably, a plurality of card feeding protrusions and a plurality of card feeding ribs are arranged alternately to achieve a better card separating effect.

In this embodiment, one side of the card sending wheel 4201 is protrudingly formed with arc-shaped teeth, so that the playing cards can be pushed up and forward during the rotation of the card sending wheel 4201, and therefore the playing cards can better cross the card feeding protrusion. In addition, performing this action can also avoid that the playing cards abutting against each other from being jammed when the card dealing device withdraws the cards. The card distribution press wheel passively rotates in one direction. In order to facilitate adjustment, the card distribution press wheel 4222 is installed at the bottom portion of the card stopper plate through an elastic pressing mechanism. The elastic pressing mechanism is a compression spring and a top rod, a one-way clutching mechanism is a one-way clutch mounted on the shaft of the card distribution press wheel. Each of the card distribution wheel, the card sending wheel, and the card distribution press wheel can be a roller part, or can be composed of multiple wheel-shaped parts mounted on the same shaft. For example, each card distribution wheel includes a support frame with a certain rigidity and a rubber ring sleeved and fixed on the support frame. Part of the arc-shaped circumference of the rubber ring is a protruding arc-shaped rubber tooth configured to be in contact with the playing cards. The circumference excluding the arc-shaped rubber tooth of the rubber ring is lower than the circumference of the side wall of the support frame. In this way, when the arc-shaped rubber tooth of the card distribution wheel comes into contact partially with the playing cards, the friction is greater and it is easier to drive the playing cards to move. When the side wall circumference of the support frame of the card distribution wheel contacts the playing cards, the friction is small and it is difficult to drive the playing cards to move. By moving the playing cards at intervals, it helps to separate two playing cards. Four card distribution wheels 4202 are installed on the same card distribution axle 42021. The card feeding rib and card distribution press wheel 4222 at the bottom portion of the card stopper plate and the four card distribution wheels 4202 are arranged alternately in up-down direction, which is convenient for adjusting the gaps in the up-down direction, thereby realizing card distribution quickly and effectively. The card sending axle 42011 of the card sending wheel 4201 and the card distribution axle 42021 of the card distribution wheel 4202 are in transmission connection through the card feeding transmission belt, so as to realize the cooperative rotation of the card sending wheel 4201 and the card distribution wheel 4202, thereby improving the card distribution efficiency and the card distribution effect.

The delivery mechanism includes the first delivery wheel 4203 and the second delivery wheel 4205 installed on the delivery bottom wall 4204 of the delivery passage, and the first delivery press wheel 4219 and the second delivery press wheel 4217 installed on the delivery top wall 4218 of the delivery passage. The first delivery press wheel 4219 and the first delivery wheel 4203 operate cooperatively in up-down direction, and the second delivery press wheel 4217 and the second delivery wheel 4205 operate cooperatively in up-down direction. The first delivery press wheel 4219 and the second delivery press wheel 4217 are driven wheels, and the first delivery wheel 4203 and the second delivery wheel 4205 are driving wheels and are covered with rubber rings to increase friction. The first delivery axle 42031 of the first delivery wheel 4203, the second delivery axle 42051 of the second delivery wheel 4205, and the card distribution axle 4202 of the card distribution wheel 4202 and the card dealing motor shaft of the card dealing motor 4220 are in transmission connection through the card dealing transmission belt. The card dealing transmission belt is tensioned through the tensioning wheel 4226, thus realizing the synchronous movement of card feeding, card distribution and card delivery. These parts, including the first delivery wheel 4203, the second delivery wheel 4205, the first delivery press wheel 4219, and the second delivery press wheel 4217, can be press-fitted in up-down direction, or staggered and misaligned in up-down direction. Each of the parts can be a roller part, or can be composed of multiple wheel-shaped parts mounted on the same shaft.

Figure 38:
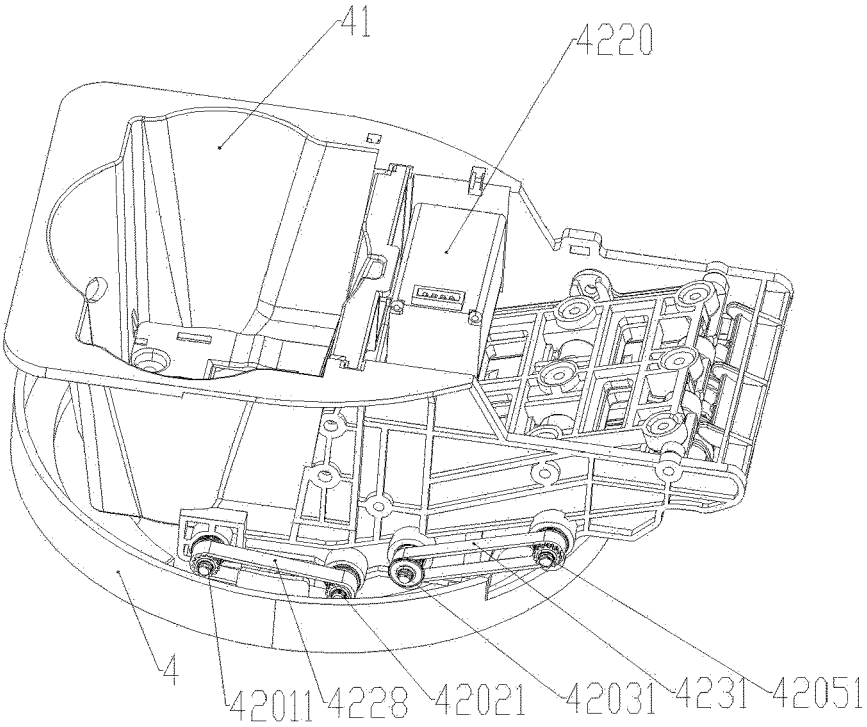
FIG. 38 is a first perspective view of the card distribution mechanism and the delivery structure in the second embodiment of the disclosure (part of the housing is omitted).
Figure 39:
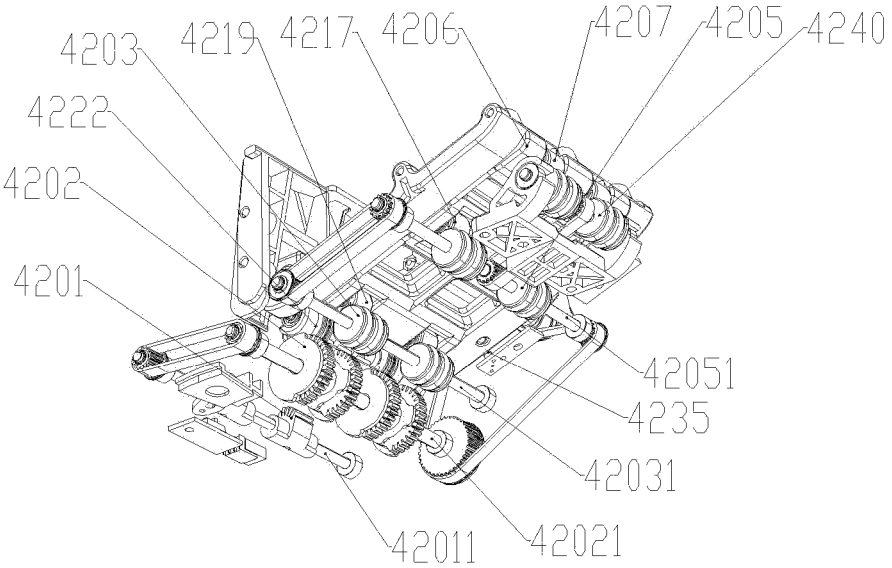
FIG. 39 is a second perspective view of the card distribution mechanism and the delivery structure in the second embodiment of the disclosure (part of the housing is omitted).

As shown in FIG. 38, the delivery passage of the card dealer is provided with multiple detection components for detecting whether the playing cards in the delivery passage are overlapped.

Regarding identifying whether the playing cards in the delivery passage overlap each other, one method is to detect the length of the playing cards. When the detection component detects that the playing cards in the delivery passage are longer than the normal length, it can be determined that there are multiple playing cards overlapping each other. Another method is to detect the thickness of the playing cards. When the detection component detects that the thickness of the playing cards in the card feeding passage, the delivery passage, or the first card discharging passage is greater than the normal thickness, it can be determined that there are multiple playing cards overlapping each other. One or more methods can be adopted in the same card dealing device.

When it is identified that the playing cards are overlapped and need to be withdrawn from the card dealing device, the card dealing motor 4220 drives the first delivery wheel 4203, the second delivery wheel 4205, the card distribution wheel 4202, and the card sending wheel 4201 to reverse so as to implement card withdrawal. One or more methods can be adopted in the same card dealing device.

As shown in FIG. 38, in this embodiment, the delivery top wall 4218 or the delivery bottom wall 4204 of the delivery passage is provided with a first sensor 4235 and a third sensor 4237 arranged in sequence along the forwarding direction of the playing cards. Through the cooperative operation between the first sensor 4235 and the third sensor 4237, the length and distance simultaneously covered by the playing cards in the delivery passage are detected to determine whether there are multiple playing cards overlapping each other. If the first sensor 4235 and the third sensor 4237 are blocked simultaneously (the playing cards are detected), it is determined that there are two partially overlapping playing cards entering the delivery passage, and the card dealing motor 4220 reverses and returns the playing cards to the card storage box 41 to feed and distribute the cards again, thereby ensuring the accuracy of the number of the playing cards.

In the situation where the playing cards are delivered forward in a direction along the width edge in the card dealing device (that is, the width of the delivery passage is similar to the width of the playing cards), the distance between the first sensor 4235 and the third sensor 4237 is 2 mm to 3 mm greater than the length of the playing card.

In the situation where the playing cards are delivered forward in a direction along the length edge in the card dealing device (that is, the width of the delivery passage is similar to the length of the playing cards), the distance between the first sensor 4235 and the third sensor 4237 is 2 mm to 3 mm greater than the width of the playing card.

Figure 40:
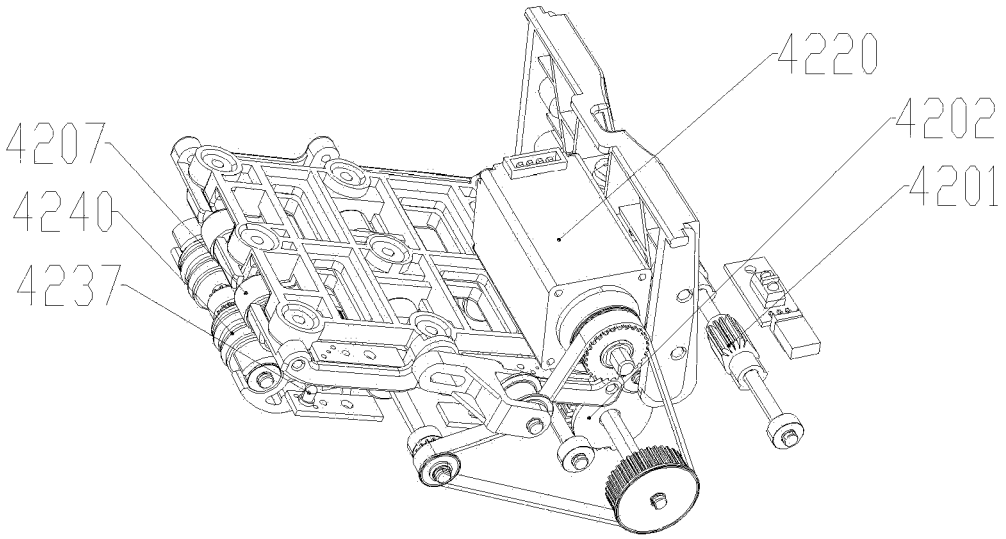
FIG. 40 is a third perspective view of the card distribution mechanism and the delivery structure in the second embodiment of the disclosure (part of the housing is omitted).

As shown in FIG. 40, the card discharging outlet of the delivery passage is provided with a card discharging wheel 4240 and its first card discharge pressing wheel 4207. The card discharging wheel 4240 is a driving wheel. The card discharging wheel 4240 is in transmission connection with the second delivery wheel 4205 through a transmission belt. The first card discharge pressing wheel 4207 that operates cooperatively with the card discharging wheel 4240 to deal cards are driven wheels. Playing cards are sent from the gap between the card discharging wheel 4240 and the first card discharge pressing wheel 4207 to the card reception position of the card receptor 2.

In this embodiment, the card dealer does not have the card flip function. There is only the first card discharging passage formed by the card discharging wheel 4240 and the first card discharge pressing wheel 4207. Therefore, it is equivalent to that the second card discharging passage is omitted on basis of the first embodiment, and only the first card discharging passage formed by the card turning wheel and the first card discharge pressing wheel is retained. In this way, the spontaneous card dealing function of the card turning wheel in the first embodiment is performed by the card discharging wheel 4240 in this embodiment.

It should be noted that in other embodiments of the disclosure, the first card discharging passage may not be directly connected to the outlet of the card reception position of the card receptor 2. That is, one or more passages (or delivery wheels/rollers) for continuing to deliver the playing cards may be further provided following the first card discharging passage, then the playing cards are sent to the card reception position of the card receptor 2.

The card discharging wheel 4240 and the first card discharge pressing wheel 4207 may be roller parts or composed by multiple wheel-shaped parts arranged on the same shaft. In this embodiment, the card discharging wheel 4240 and the first card discharge pressing wheel 4207 all include multiple wheels installed on their respective shafts. In this design, the structure is simple and the installation and cooperative operation are convenient. A rubber ring can be arranged on the card discharging wheel 4240 and the first card discharge pressing wheel 4207 to increase the friction between them and the playing cards.

In order to ensure the delivery pressure and avoid slipping, it is preferable to give the first card discharge pressing wheel 4207 the tendency of pressing the card discharging wheel 4240 through the respective energizing mechanism. These energizing mechanisms can be elastic components such as springs, elastic sheets, elastic rings, or elastic shafts, or they can be elastic energizing mechanisms composed of multiple components. In this embodiment, the first card discharge pressing wheel 4207 is rotatably installed on the first card discharge pressing wheel frame 4206. The first card discharge pressing wheel frame 4206 is movably connected with the delivery top wall 4218 of the delivery passage, and a compression spring is used to facilitate the first card discharge pressing wheel 4207 to press the card discharging wheel 4240 tightly. In this way, the installation is convenient, and the structure is simple and reliable.

The playing cards sorting method for the playing card machine described above includes the following steps.

1) Placing the playing cards sorted into a pile into the card storage box.

2) The card distribution mechanism separates a pile of playing cards that are organized in the card storage box into single pieces and distribute them to the delivery mechanism.

3) The delivery mechanism sends the playing cards to each card reception position on the card receptor.

In the description of this specification, descriptions with reference to the terms "one embodiment", "some embodiments", "examples", "specific examples", or "some examples" etc. mean specific features, structure, materials or characteristics combined with the embodiment or example are included in at least one embodiment or example of the disclosure. In this specification, the schematic description of the above-mentioned terms do not necessarily refer to the same embodiment or example. Moreover, the described specific features, structures, materials or characteristics can be combined in any one or more embodiments or examples in a suitable manner.

Although the embodiments of the disclosure have been shown and described above, it can be understood that the above embodiments are exemplary and should not be construed as limiting the present disclosure. Changes, modifications, substitutions and modifications can be made by those of ordinary skill in the art without deviating from the principle and purpose of the present disclosure. Any simple modifications, equivalent changes and modifications made to the above embodiments based on the technical essence of the present disclosure still fall within the scope of technical solution in the present disclosure.

What is claimed is:

1. A playing card machine, comprising: a base and a machine core, wherein the machine core is arranged on the base or inside the base, and the machine core comprises a card receptor and a card dealer;

the machine core is able to driven to move up and down on the base by a machine core lifting drive mechanism; the card dealer is arranged at a center of the card receptor and is able to be driven by a rotation drive mechanism to rotate relative to the card receptor;

the card dealer comprises a card storage box, a card distribution mechanism, and a delivery mechanism; the card receptor is provided with a plurality of card reception positions around the card dealer; the card dealer has a passage for playing cards to pass therethrough, the passage comprises a card feeding passage, a delivery passage and a first card discharging passage that are connected in sequence; the card distribution mechanism is arranged at the card feeding passage of the card dealer, and the delivery mechanism is arranged at the delivery passage of the card dealer;

the card distribution mechanism comprises a card stopper plate, a card sending wheel, a card distribution wheel and a card distribution press wheel the card sending wheel is configured to push the playing cards to the card feeding passage of the card dealer and is disposed at a bottom portion of the card storage box; the card distribution press wheel is disposed at a bottom portion of the card stopper plate; the card distribution wheel is disposed below the card distribution press wheel; the card distribution wheel is driven to rotate by a card dealing motor; the card distribution press wheel performs non-rotation when the playing cards are fed in and performs rotation when the playing cards are discharged by an one-way clutching mechanism;

an axis of the card distribution press wheel and an axis of the card distribution wheel are staggered by a horizontal distance, and the axis of the card distribution press wheel is closer to a card storing space of the card storage box than the axis of the card distribution wheel; a bottommost point of the card distribution press wheel is lower than a highest point of the card distribution wheel;

the delivery mechanism comprises a first delivery wheel and a second delivery wheel disposed on a delivery bottom wall of the delivery passage, and a first delivery press wheel and a second delivery press wheel disposed on a delivery top wall of the delivery passage; the first delivery press wheel and the first delivery wheel operate cooperatively in an up-down manner, and the second delivery press wheel and the second delivery wheel operate cooperatively in an up-down manner; the first delivery press wheel and the second delivery press wheel are driven wheels; the first delivery wheel, the second delivery wheel and the card distribution wheel are in transmission connection with the card dealing motor; a plurality of detection components for detecting the playing cards are provided in the delivery passage; a card discharging wheel and a first card discharge pressing wheel thereof are disposed at a card outlet of the first card discharging passage; the card discharging wheel is a driving wheel and is in transmission connection with the card dealing motor; the first card discharge pressing wheel that operates cooperatively with the card discharging wheel is a driven wheel.

2. The playing card machine according to claim 1, wherein a top portion of the card receptor is provided with a panel having a card placing hole; a door plate is provided on the card placing hole, and the card storage box is provided below the card placing hole; the card receptor and the base are movable up and down relative to each other by cooperation of a plurality of guide columns and guide sleeves or cooperation of slots and sliding blocks, the guide columns and guide sleeves and the slots and sliding blocks are arranged around the card receptor and the base; a card pushing plate and a card pushing slot are disposed on each card reception position, the card pushing plate is driven to reciprocate from an inner side of the card reception position to an outer side of the card reception position by a card pushing drive mechanism.

3. The playing card machine according to claim 2, wherein the card pushing drive mechanism is arranged under the card receptor, and comprises a card pushing motor, a card pushing drive member, and a plurality of card pushing swing arms corresponding to the plurality of card pushing plates one-to-one; the card pushing drive member has a circular ring shape, and the card pushing drive member is disposed at a bottom portion of the card receptor and driven to rotate by the card pushing motor; a plurality of drive parts extend from an outer circumference of the card pushing drive member and correspond to the plurality of card pushing swing arms one-to-one; one of the drive parts is movably connected to a middle portion of a respective one of the card pushing swing arms; one end of each of the card pushing swing arms is movably connected to the bottom portion of the card receptor, and the other end of each of the card pushing swing arms is movably connected to a bottom portion of the card pushing plate, such that the card pushing drive member is rotatable to push each of the card pushing swing arms to rotate, and that the card pushing plate is pushed to perform a card pushing action from the inner side toward the outer side of the card reception position, or to perform a reciprocating action from the outer side toward the inner side of the card reception position.

4. The playing card machine according to claim 1, wherein the machine core lifting drive mechanism comprises a lifting drive member, a lifting motor, and a plurality of lifting swing arms; the plurality of lifting swing arms are evenly distributed under the card receptor of the machine core; one end of each of the lifting swing arms is hinged with the base, and the other end of each of the lifting swing arms abuts against a bottom portion of the card receptor of the machine core; the lifting motor is able to drive rotation of the lifting drive member, such that the plurality of lifting swing arms are driven to simultaneously swing up and down by the lifting drive member, and that the machine core is lifted and lowered up and down.

5. The playing card machine according to claim 1, wherein the card storage box is located on one side of the card dealer, the card distribution mechanism and the delivery mechanism are located on another side of the card dealer, and a side of the bottom portion of the card storage box communicates with the card feeding passage of the card dealer.

6. The playing card machine according to claim 1, wherein the card storage box is configured for placement of a pile of the playing cards that are organized; a detection sensor for detecting whether the playing cards are placed in the card storage box and the card sending wheel configured to push the playing cards to the card feeding passage of the card dealer is disposed at the bottom portion of the card storage box, the card stopper plate is formed on a side wall of the card storage box close to the card feeding passage of the card dealer; a plurality of card feeding ribs are provided on the card stopper plate; the card distribution wheel of the card dealer is provided under the card feeding ribs; a plurality of card feeding protrusions are formed on an inner wall at the bottom portion of the card storage box between the card sending wheel and the card distribution wheel, such that the card feeding passage is defined between the plurality of card feeding protrusions and the card feeding ribs.

7. The playing card machine according to claim 1, wherein the rotation drive mechanism comprises a rotating motor installed at a bottom portion of the card receptor and a driven wheel that rotates synchronously with a dealer seat in a fixed circumferential direction; the rotating motor drives the driven wheel through a rotating transmission belt to drive the dealer seat to rotate.

8. A delivery mechanism of a playing card machine, comprising a first delivery wheel and a second delivery wheel disposed on a delivery bottom wall of a delivery passage, and a first delivery press wheel and a second delivery press wheel disposed on a delivery top wall of the delivery passage; the first delivery press wheel and the first delivery wheel operate cooperatively in an up-down manner; the second delivery press wheel and the second delivery wheel operate cooperatively in an up-down manner; the first delivery press wheel and the second delivery press wheel are driven wheels; the first delivery wheel, the second delivery wheel and a card distribution wheel are in transmission connection with a card dealing motor; an identification component for identifying front and rear sides of playing cards and a plurality of detection components for detecting the playing cards are provided in the delivery passage.

9. The delivery mechanism of the playing card machine according to claim 8, wherein the identification component configured to identify the front and rear sides of the playing cards is a camera; the camera and a detection sensor for detecting presence of the playing cards are fixed on the delivery bottom wall or the delivery top wall of the delivery passage; when the detection sensor detects the playing cards, the camera is activated at the same time or delayedly, and the camera captures pattern information on a diagonally fixed position of the playing cards in the delivery passage.

10. The delivery mechanism of the playing card machine according to claim 9, wherein a value range of a vertical distance M between a lens center of the camera and a left side wall or a right side wall of the delivery passage adjacent thereto is: a vertical distance between a character pattern of the playing card and an adjacent side edge of the playing card<M<a vertical distance between the character pattern of the playing card and the adjacent side edge of the playing card+5 mm;

a value range of a vertical distance H between the lens center of the camera and the playing cards in the delivery passage is: 10 mm<H<15 mm.

11. The delivery mechanism of the playing card machine according to claim 9, wherein the detection sensor for detecting the presence of the playing cards and the camera are arranged adjacent to each other in a left-right direction; two cameras are arranged in the delivery passage, and the two cameras are respectively close to a left side wall and a right side wall of the delivery passage.

12. The delivery mechanism of the playing card machine according to claim 8, wherein the plurality of detection components for detecting the playing cards include a first sensor, a second sensor, and a third sensor that are sequentially installed along a forwarding direction of the playing cards on the delivery top wall or the delivery bottom wall of the delivery passage; the first sensor and the third sensor cooperatively detect a length distance simultaneously covered by the playing cards in the delivery passage to determine whether the plurality of playing cards are overlapped;

in a situation where the playing cards are delivered forward in a direction along a width edge in the card dealing device, a distance between the first sensor and the third sensor is 2 mm to 3 mm larger than a length of the playing cards;

in a situation where the playing cards are delivered forward in a direction along a length edge in the card dealing device, the distance between the first sensor and the third sensor is 2 mm to 3 mm larger than a width of the playing cards.

13. The delivery mechanism of the playing card machine according to claim 12, wherein the first sensor, the second sensor and the third sensor are photoelectric sensing modules.

* * * * *